US007734231B2

(12) United States Patent
Eto et al.

(10) Patent No.: US 7,734,231 B2
(45) Date of Patent: Jun. 8, 2010

(54) TONER CONTAINER, DEVELOPER REPLENISHING DEVICE, AND IMAGE FORMING APPARATUS

(75) Inventors: Daisuke Eto, Osaka (JP); Toshinori Nishimura, Osaka (JP); Yoshiaki Ikebata, Osaka (JP)

(73) Assignee: Kyocera Mita Corporation (JP)

( * ) Notice: Subject to any disclaimer, the term of this patent is extended or adjusted under 35 U.S.C. 154(b) by 114 days.

(21) Appl. No.: 12/018,445

(22) Filed: Jan. 23, 2008

(65) Prior Publication Data

US 2008/0175629 A1 Jul. 24, 2008

(30) Foreign Application Priority Data

Jan. 24, 2007 (JP) ..... 2007-013787

(51) Int. Cl.
*G03G 15/08* (2006.01)

(52) U.S. Cl. ..... 399/262; 399/120

(58) Field of Classification Search ..... 399/262, 399/119, 120

See application file for complete search history.

(56) References Cited

U.S. PATENT DOCUMENTS

| | | | | |
|---|---|---|---|---|
| 5,848,516 | A | 12/1998 | Ban | 53/453 |
| 6,668,145 | B2 * | 12/2003 | Wang et al. | 399/262 X |
| 2003/0086723 | A1 | 5/2003 | Yamaguchi et al. | |
| 2004/0037587 | A1 | 2/2004 | Yamaguchi et al. | |
| 2004/0105703 | A1 * | 6/2004 | Nozawa | 399/262 X |
| 2005/0008395 | A1 | 1/2005 | Yamaguchi et al. | |
| 2005/0175373 | A1 | 8/2005 | Okamoto et al. | |
| 2006/0013621 | A1 | 1/2006 | Kimura et al. | |
| 2006/0263116 | A1 * | 11/2006 | Katsuyama | 399/262 X |
| 2008/0025764 | A1 | 1/2008 | Kimura et al. | |
| 2008/0170888 | A1 | 7/2008 | Eto et al. | |

FOREIGN PATENT DOCUMENTS

| | | |
|---|---|---|
| CN | 1655073 | 8/2005 |
| CN | 1677267 | 10/2005 |
| CN | 1722021 | 1/2006 |
| EP | 0 701 181 A2 | 3/1996 |
| EP | 1 944 660 | 7/2008 |
| JP | 2003-280344 | 10/2003 |

* cited by examiner

*Primary Examiner*—Sophia S Chen
(74) *Attorney, Agent, or Firm*—Gerald E. Hespos; Michael J. Porco

(57) ABSTRACT

A toner container adapted for containing toner includes a first side wall and a second side wall opposed to each other. The toner container longitudinally extends between the first side wall and the second side wall and includes a handle to be held when the container is attached to or detached from the apparatus main body and a retaining portion provided on the first side wall to be engaged with a portion of the apparatus main body when the container is installed in the apparatus main body. The handle is provided at a position shifted to the second side wall from a center of the container in the longitudinal direction.

18 Claims, 23 Drawing Sheets

+Y
-Y
20'
30
Q
84(85)
843
822
821
734
733
735
732(70)
81
80
82
60
64
641
642

TONER CONTAINER, DEVELOPER REPLENISHING DEVICE, AND IMAGE FORMING APPARATUS

BACKGROUND OF THE INVENTION

1. Field of the Invention

The present invention relates to a toner container and a developer replenishing device which is detachably installed to an image forming apparatus, such as a copying machine, a printer, a facsimile machine, and the like with toner, in order to replenish a developing device provided in the image forming apparatus, and an image forming apparatus to which such toner container or developer replenishing device is installed.

2. Description of the Related Art

A toner container disclosed in Japanese Unexamined Patent Publication (Kokai) No. 2003-280344 is known as prior art. The toner container includes a box-like container to be charged with toner and a toner replenishing device provided at a bottom of the container in order to discharge toner to replenish a developing device with the toner.

Such a toner container is attached to or detached from an apparatus main body with an end (for example, top end corner) of the container held by a user.

Since a toner container is manufactured to allow the container to contain a predetermined amount of toner and to smoothly replenish the developing device with the toner within the container, an ease for attachment and detachment of the container to and from the apparatus main body of the image forming apparatus is hardly considered. Therefore, it is typical that the container is attached to or detached from the apparatus main body while an end of the container is held by the user.

However, if the user attempts to attach and detach the toner container while he/she is holding the container, the container is not always in a state of enabling the user to hold it with ease. In this regard, there are often such cases that the user cannot stably hold the container, which causes a troublesome in attachment and detachment of the container.

Also, if the image forming apparatus, for example, is for the use of multi-color print in which a plurality of toner containers containing different colors of toner are installed side by side into the apparatus main body, there have been such problems that it is difficult to insert fingers between two adjacent toner containers and thus to hold the container easily and securely.

SUMMARY OF THE INVENTION

An object of the present invention is to provide a technology which can allow a user to hold a container easily and securely, thereby enabling the user to attach and detach the container to and from the image forming apparatus.

A toner container according to an aspect of the present invention which achieves the above object is adapted for containing toner, and includes a first side wall and a second side wall opposed to each other. The container longitudinally extends between the first side wall and the second side wall and includes a handle to be held when the user attaches and detaches the container to and from the apparatus main body and a retaining portion which is provided on the first side wall and be engaged with a portion of the apparatus main body. The handle is provided at a position shifted to the second side wall from a center of the container in a longitudinal direction.

An image forming apparatus according to another aspect of the present invention includes: an image carrier for carrying a toner image; a developing device for supplying toner to the image carrier; a toner container for replenishing the developing device with toner; and an apparatus main body which accommodates the image carrier, the developing device, and the toner container and includes a first retaining portion provided at a position corresponding to a mounting position of the toner container. The toner container is adapted for containing the toner and includes a container having a first side wall and a second side wall opposing to each other. The container longitudinally extends between the first side wall and the second side wall and includes a handle to be held at a time of attachment and detachment of the container to and from the apparatus main body and a second retaining portion provided on the first side wall and be engaged with the first retaining portion when the container is installed in the apparatus main body. The handle is provided at a position shifted to the second side wall from a center of the container in the longitudinal direction.

BRIEF DESCRIPTION OF THE DRAWINGS

FIGS. 1A and 1B are external perspective views illustrating a printer to which a toner container embodying the present invention is provided, in which FIG. 1A is a perspective view when the printer is viewed from its right rear direction and FIG. 1B is a perspective view when the printer is viewed from its left rear direction.

FIGS. 2A and 2B are perspective views each illustrating the printer with a paper output tray removed from an apparatus main body, in which FIG. 2A is a perspective view when the printer is viewed from its right rear direction and FIG. 2B is a perspective view when the printer is viewed from its left rear direction.

FIG. 18A illustrates the shutter cylinder in the closed position; FIG. 18B illustrates the shutter cylinder about to change its position from the closed position to the open position; and FIG. 18C illustrates the shutter cylinder with its position changed to the open position.

DETAILED DESCRIPTION OF THE PREFERRED EMBODIMENTS

Embodiments of the present invention will be described below in detail with reference to the accompanying drawings.

First Embodiment

An image forming apparatus to which a toner container 20 according to a first embodiment is applied will be briefly described with reference to FIGS. 1, 2, and 3, exemplifying a printer 10.

Figure 1A:
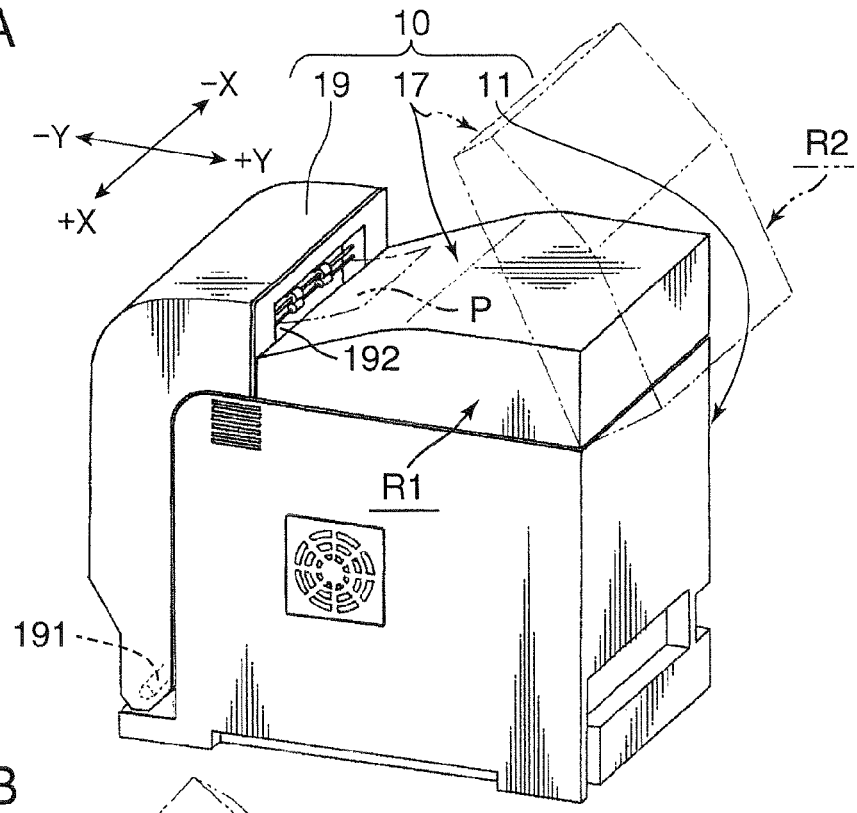
Figure 1B:
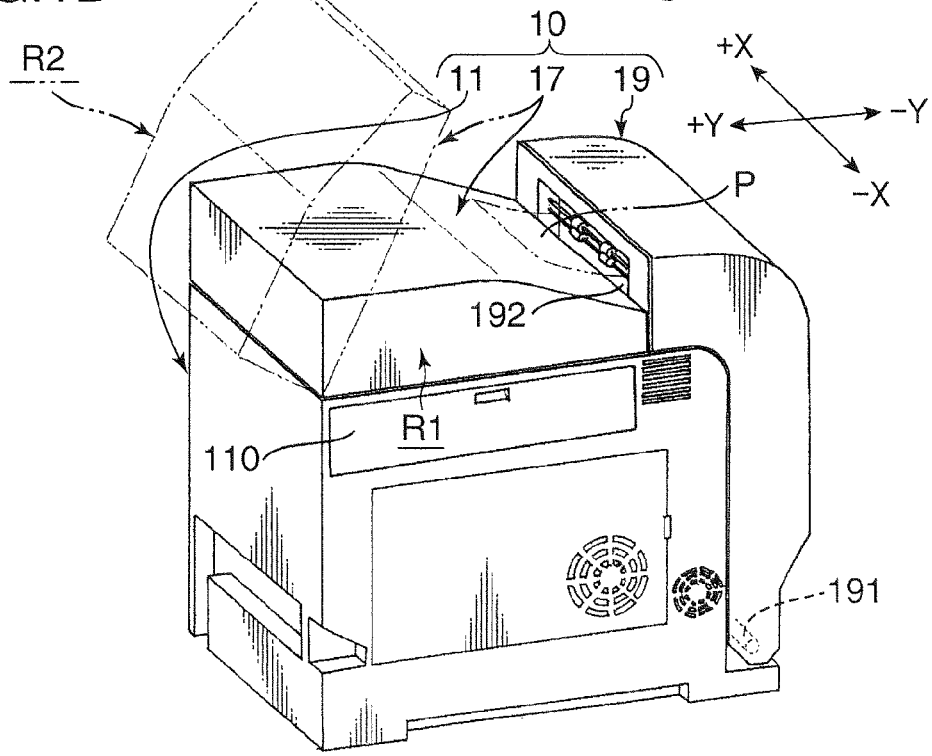
Figure 2A:
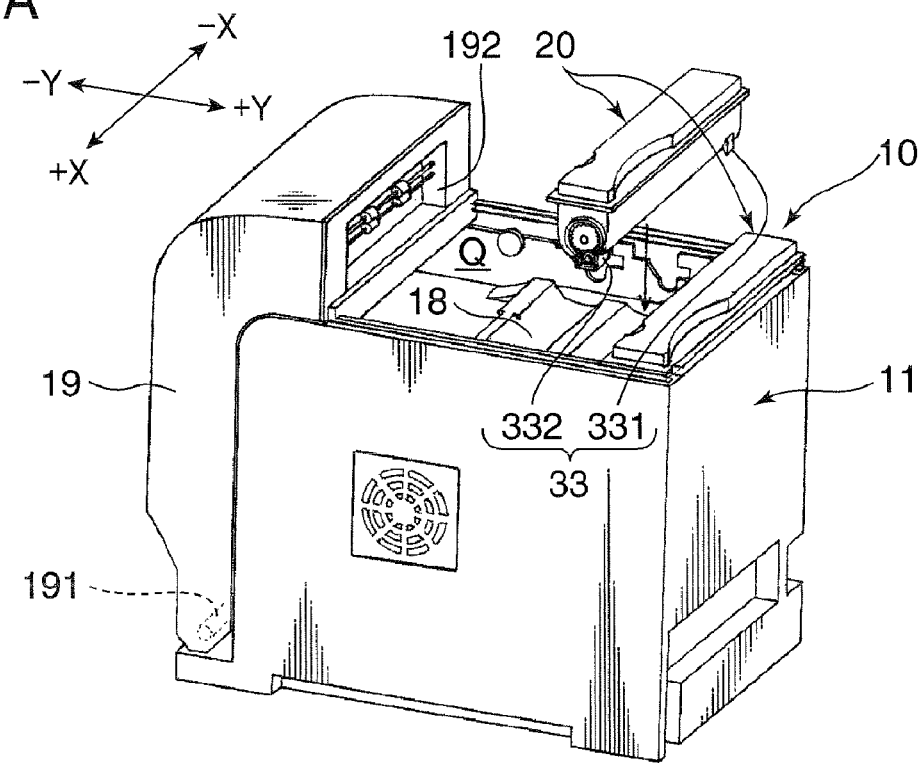
Figure 2B:
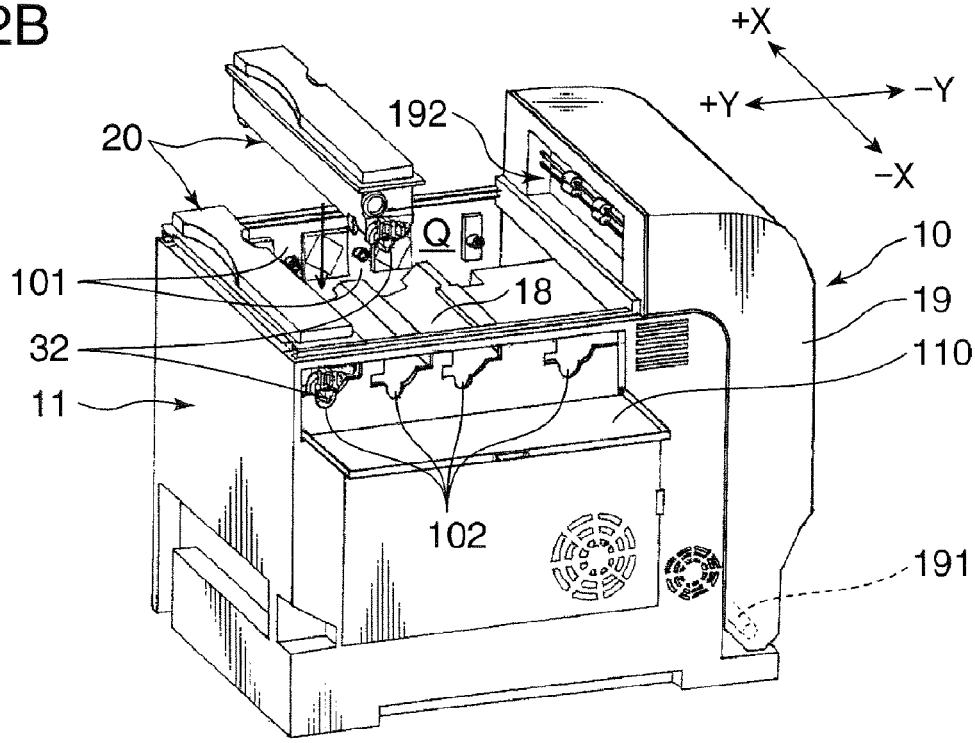
Figure 3:
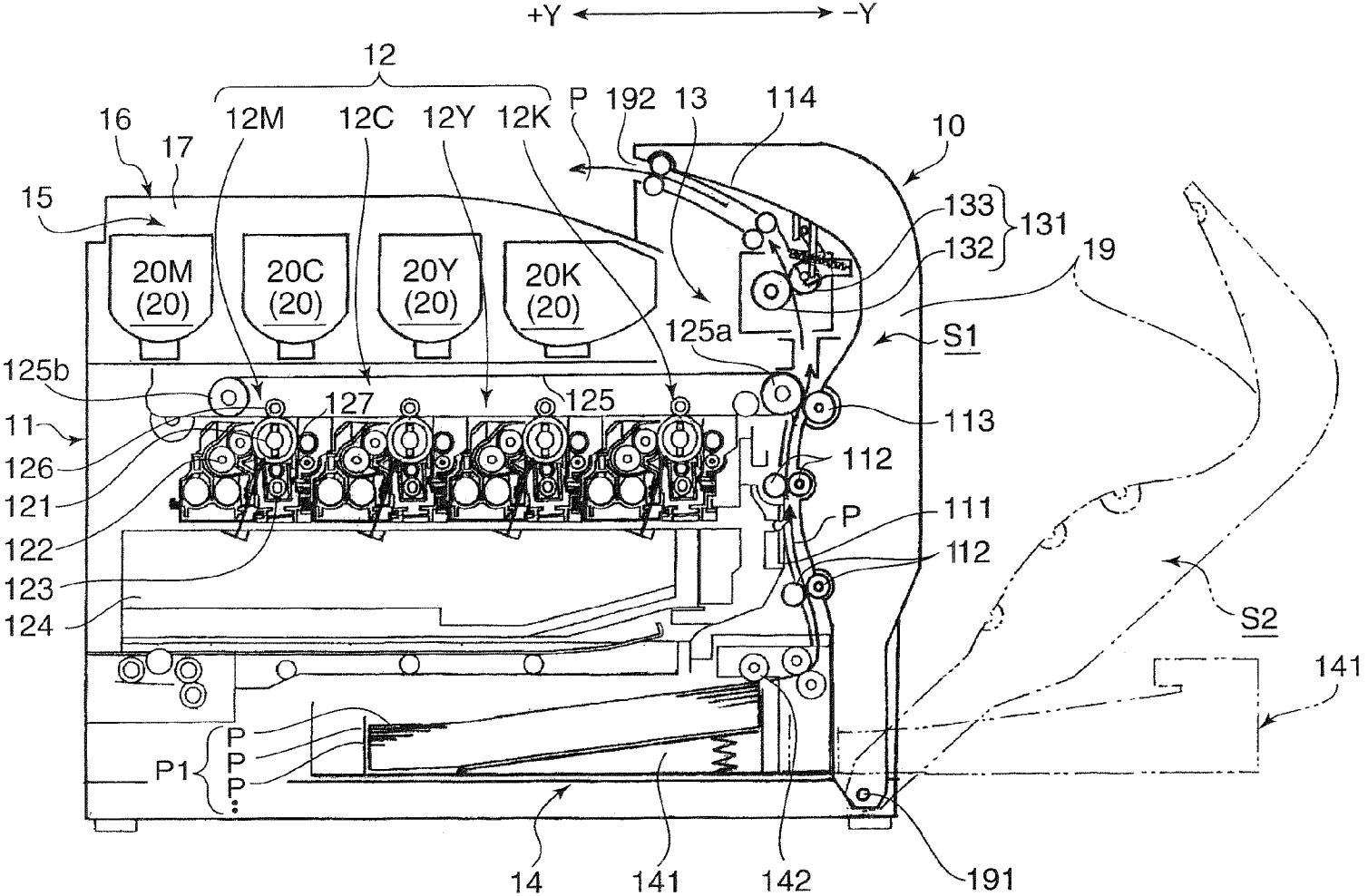
FIG. 3 is a cross sectional view illustrating an internal structure of the printer when it is viewed from its left side.

FIGS. 1A through 2B are external perspective views illustrating the printer 10. FIGS. 1A and 1B illustrate a paper output tray 17 installed in an apparatus main body 11; and FIGS. 2A and 2B illustrate the paper output tray 17 removed from the apparatus main body 11. FIGS. 1A through 2B are external perspective views illustrating the printer to which the toner container is provided. FIGS. 1A and 2A are perspective views when the printer is viewed from a right rear direction; and FIGS. 1B and 2B are perspective views when the printer is viewed from a left rear direction. FIG. 3 is a cross sectional view of an internal structure of the apparatus main body 11 viewed from a left side. In FIGS. 1 through 3, the X-X direction is referred to as a widthwise direction and the Y-Y direction is referred to as a forward and backward direction. More specifically, −X direction is referred to as the leftward, +X direction is referred to as the rightward, −Y direction is referred to as the forward, and +Y direction is referred to as the backward. In FIGS. 1A through 2B, an actual widthwise direction over the drawing paper is opposite to that indicated by X.

The printer 10 includes a box-shaped apparatus main body 11 including therein various members for forming images that will be described later, a paper output tray 17 provided on a top surface of the apparatus main body 11 in an openable and closable manner, and a covering body 19 provided on a front surface of the apparatus main body 11 in an openable and closable manner.

The paper output tray 17 receives a paper sheet P discharged after it is subjected to an image forming process within the apparatus main body 11. The paper output tray 17 rotates forward and backward around a back lower end of the paper output tray 17, thereby enabling a change of position between a closed position R1 where an opening in the top surface of the apparatus main body 11 is closed as illustrated by a solid line in FIG. 1, and a open position R2 where the opening is open as illustrated by a broken line in FIG. 1. The paper output tray 17 has an inclined surface which is formed such that a front surface of a front half thereof declines forward, and the paper sheet P discharged from an upper rear surface of the covering body 19 is discharged onto the paper output tray 17 guided by this declined surface.

The paper output tray 17 is detachable from the apparatus main body 11. As shown in FIG. 3, the top surface of the apparatus main body 11 is provided with an opening starting at the upper rear of the covering body 19 and extending backwards to the rear side of the apparatus main body 11. This opening makes it possible to attach and detach a toner container 20, which will be described below, when the paper output tray 17 is removed. Slightly below the opening, there is provided a partition 18 for partitioning off an image forming portion 12 in the lower section. The toner container 20 is detachably installed in the apparatus main body 11 with the toner container being supported by a top surface of this partition 18.

The covering body 19 has a reverse-L shape when viewed from the side or from the +X direction, and an upper section of the covering body 11 hangs over an upper front corner of the apparatus main body 11. The covering body 19 is rotatable at its bottom end around a support shaft 191 provided on a predetermined frame of the apparatus main body 11, thereby being able to change its position between a closed position S1 where the front opening of the apparatus main body 11 is closed and an open position S2 where the front opening of the apparatus main body 11 is open as illustrated by an alternating long and two dashed line in FIG. 3. A rear surface of the top end of the covering body 19 is formed with a paper discharge opening 192 for discharging the paper sheet P onto the paper output tray 17. The paper sheet P passes between a front surface of the apparatus main body 11 and a rear surface of the covering body to be discharged onto the paper output tray 17 through the paper discharge opening 192.

An internal structure of the apparatus main body 11 will be described below with reference to FIG. 3. The apparatus main body 11 includes therein an image forming portion 12 for forming an image on the basis of image information from an external apparatus such as a computer, a fixing portion 13 for fixing the toner image formed by this image forming portion 12 and transferred onto the paper sheet P, a paper stacker 14 for stacking the papers, and a toner replenish portion 15 for replenishing the image forming portion 12 with toner. A paper discharge section 16 comprising the paper output tray 17 is formed on the apparatus main body 11 in order for the paper sheet P to be discharged onto the paper output tray after it is subjected to a fixing process.

A not-shown operation panel is provided at an appropriate position of the apparatus main body 11 for the purpose of inputting output conditions of the paper sheet P. This operation panel includes a not-shown electric power supply key, a start button, and other various keys for inputting other output conditions.

The image forming portion 12 forms a toner image onto the paper sheet P fed from the paper stacker 14. The present embodiment exemplifies the image forming portion 12 including a magenta unit 12M using a magenta toner (developer), a cyan unit 12C using a cyan toner, a yellow unit 12Y using a yellow toner, and a black unit 12K using a black toner sequentially arranged from upstream (rear side in FIG. 3) to downstream.

Each of the units 12M, 12C, 12Y, and 12K has a photoconductive drum 121 and a developing device 122. The photoconductive drum 121 is adapted for forming an electrostatic latent image and a toner image according to this electrostatic latent image on a peripheral surface of the photoconductive drum 121. Multiple photoconductive layers constitute the peripheral surface of the photoconductive drum 121 such as amorphous silicon layers or the like which are tough and have excellent wear resistance. Each of the photoconductive drums 121 receives toner from the corresponding developing device 122 while being rotated in a clockwise direction in FIG. 3. Each of the developing devices 122 is replenished with toner from a toner replenishing portion 15.

A charging device 123 is provided immediately under each of the photoconductive drums 121, and an exposing device 124 is further provided under each of the charging devices 123. A peripheral surface of each photoconductive drum 121 is uniformly charged by the corresponding charging device 123. The peripheral surface of the charged photoconductive drum 121 is irradiated by laser light corresponding to each color based on image data input by a computer or the like and thereby an electrostatic latent image is formed on the peripheral surface of each photoconductive drum 121. Then, toner is supplied from the developing device 122 to the electrostatic latent image to form a toner image on the peripheral surface of the photoconductive drum 121.

Above each of the photoconductive drums 121, a transfer belt 125 is stretched between a driving roller 125*a* and a driven roller 125*b* such that the transfer belt comes into contact with each of the photoconductive drums 121. This transfer belt 125 orbits between the driving roller 125*a* and the driven roller 125*b* such that it is synchronized with and pressed against the peripheral surface of the respective photoconductive drum 121 by a corresponding roller 126.

Therefore, while the transfer belt 125 orbits, a toner image of magenta toner is transferred onto the surface of the transfer belt by the photoconductive drum 121 of the magenta unit 12M, followed by a transfer of a cyan toner image, a yellow toner image, and then a black toner image at the same position on the transfer belt 125 in such a manner that the images are superimposed one another. Accordingly, a color toner image is formed on the surface of the transfer belt 125. The color toner image formed on the surface of the transfer belt 125 is further transferred onto the paper sheet P fed from the paper stacker 14.

In a forward position of each of the photoconductive drums 121, there is provided a cleaning device 127 for removing residual toner from the peripheral surface of the photoconductive drum 121 thus cleaning the surface. The peripheral surface of the photoconductive drum 121 thus cleaned by the cleaning device 127 then proceeds to the corresponding charging device 123 for the following charging process.

Waste toner removed from the peripheral surface of the photoconductive drum 121 by the cleaning device 127 is collected through a predetermined path and contained by a not-shown toner collecting bottle.

In front of the image forming portion 12, a paper feeding path 111 is formed extending vertically parallel to a back surface of the covering body 19. This paper feeding path 111 is provided with a pair of a pair of registration rollers 112 at an appropriate position, and the paper sheet P from the paper stacker 14 is conveyed toward the transfer belt 125 looped over the driving roller 125*a* by a driving force from the pair of a pair of registration rollers 112.

Such a paper feeding path 111 is provided with a second transfer roller 113 which comes into contact with the surface of the transfer belt 125 at a position opposite to the driving roller 125*a*. While the paper sheet P is conveyed through the paper feeding path 111 and pinched under pressure between the transfer belt 125 and the second transfer roller 113, the toner image on the transfer belt 125 is transferred onto the paper sheet P.

The fixing portion 13 is provided with a fixing device 131 adapted for fixing the toner image on the paper sheet P which has been transferred in the image forming portion 12 including the photoconductive drums 121, the transfer belt 125, and the like. The fixing device 131 is provided immediately above the second transfer roller 113. The paper sheet P having the toner image transferred from the transfer belt 125 is conveyed to the fixing portion 13 where it is fixed by this fixing device 131.

The fixing device 131 includes therein a fixing roller 132 with an electrical heating element such as a halogen lamp or the like and a pressure roller 133 placed opposite to the fixing roller 132 such that peripheral surfaces of both of the rollers contact each other. The paper sheet P on which an image was formed in the image forming portion 12 is then subjected to a fixing process helped by heat from the fixing roller 132 while the paper sheet P passes through a nip portion between the fixing roller 132 and the pressure roller 133 by the fixing roller 132 being driven. Then, the paper sheet P is discharged to the paper output tray 17 of the paper discharge section 16 through the paper feeding path 114 and the paper discharge opening 192 that extends above the fixing portion 13.

The paper stacker 14 is placed at a position below the exposing device 124 within the apparatus main body 11 and includes a paper tray 141 detachably installed therein. The paper tray 141 is formed into a box-like body including an entirely open top surface in order to stack a bundle of papers P1 composed of a plurality of papers Pin a layered manner. The uppermost paper sheet P of the bundle of papers P1 stacked in the paper tray 141 is forwarded to the paper feeding path 111 by a driving force of a pick up roller 142 provided at a downstream end (a front end in FIG. 3). Then, the paper sheet P passes through the paper feeding path 111 by the driving force of the pair of a pair of registration rollers 112 to be conveyed to the nip portion between the second transfer roller 113 and the transfer belt 125 in the image forming portion 12.

The toner replenishing portion 15 is provided with four toner containers 20 (a magenta container 20M, a cyan container 20C, a yellow container 20Y, and a black container 20K) corresponding to the respective units 12M, 12C, 12Y, and 12K of the image forming portion 12. The developing device 122 of each of the units 12M, 12C, 12Y, 12K is replenished with toner from each of the corresponding containers 12M, 12C, 12Y, 12K when a remaining amount of toner becomes less.

The covering body 19 is openable and closable with respect to the front side of the apparatus main body 11 by changing its position between the closed position S1 and the open position S2 as described above. The covering body 19 is normally set to the closed position S1, thereby forming the paper feeding path 111 for conveying papers from the paper stacker 14 to the second transfer roller 113, wherein the paper feeding path is formed between the covering body and the front surface of the image forming portion 12 in FIG. 3.

When the pair of a pair of registration rollers 112 and the fixing portion 13 are jammed with papers, the covering body 19 is opened. In other words, the covering body position is changed from the closed position S1 to the open position S2. Thereby, the user can easily remove the jammed papers from the paper feeding path 111 and the fixing portion 13 which are exposed to the outside.

The covering body 19 is provided therein with a reverse feeding path to reverse a paper sheet P having been passed through the fixing portion 13 to be thereby applied with the fixing process, and return it to the paper feeding path 111 to make printing to a reverse side of the paper sheet. Description and illustration thereof are omitted here.

On an upper left surface of the apparatus main body 11, there is provided a horizontally long opening and closing cover 110 which is opened when the toner container 20 is attached to or detached from the apparatus main body 11. When the toner container 20 is installed with the opening and closing cover 110 opened (FIG. 2B) and a below described operation lever 642 (FIGS. 12A, 12B) is operated, the shutter cylinder 60 for pushing the toner away is opened or closed.

Figure 4:
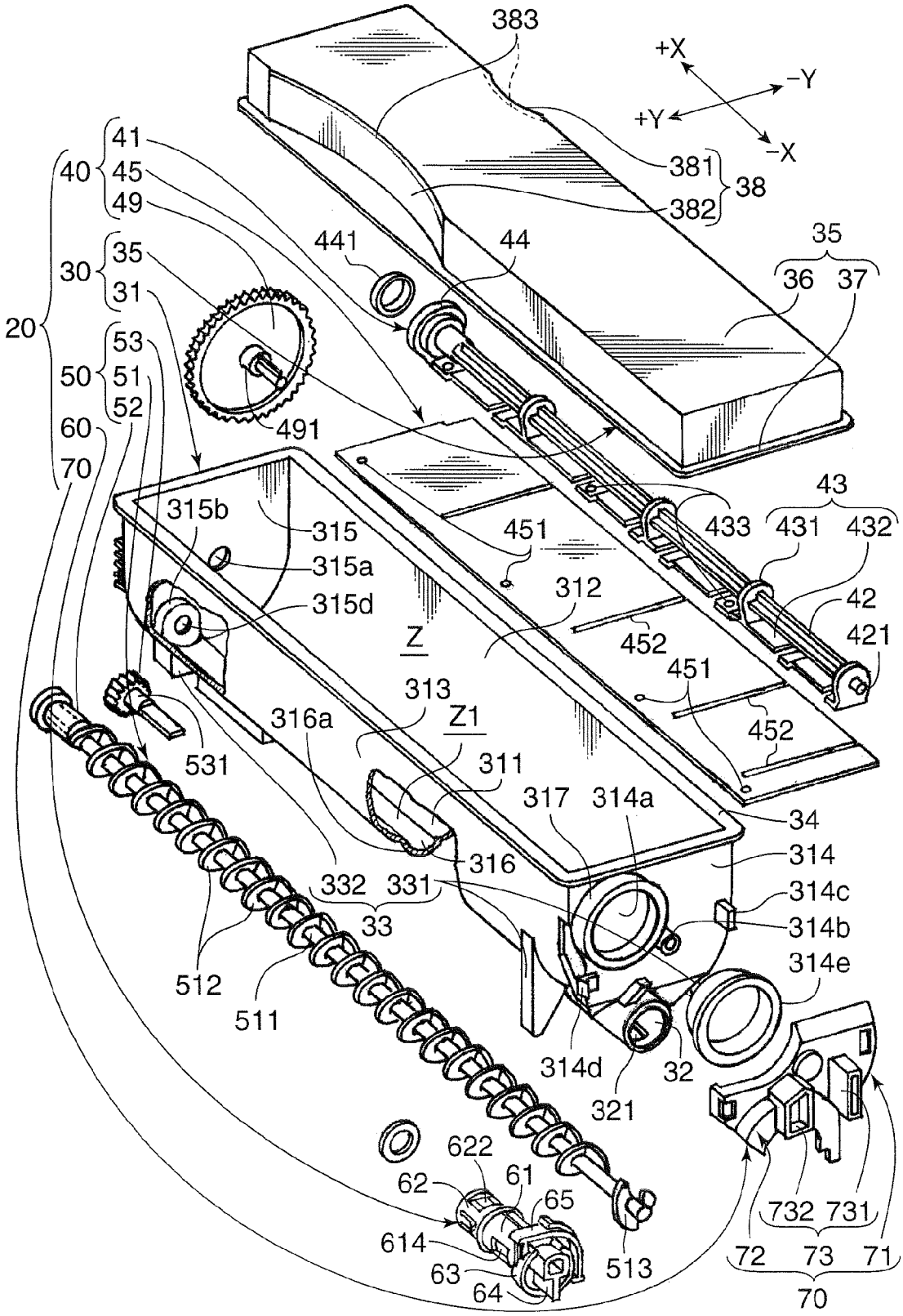
FIG. 4 is a partially cut exploded perspective view illustrating the toner container.
Figure 5:
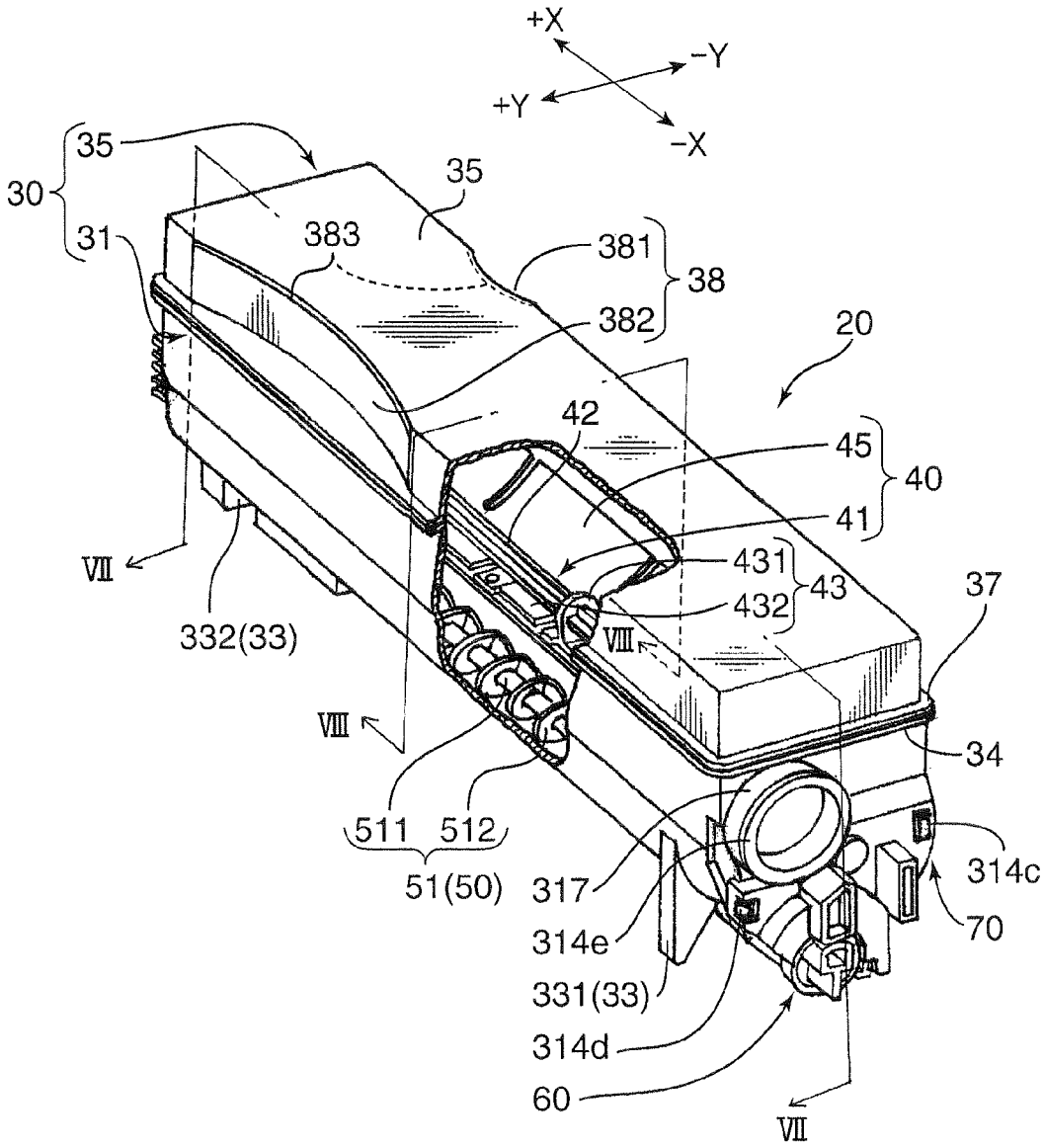
FIG. 5 is a partially cut perspective view of the assembled toner container shown in FIG. 4 when it is viewed from an obliquely upward front direction.
Figure 6:
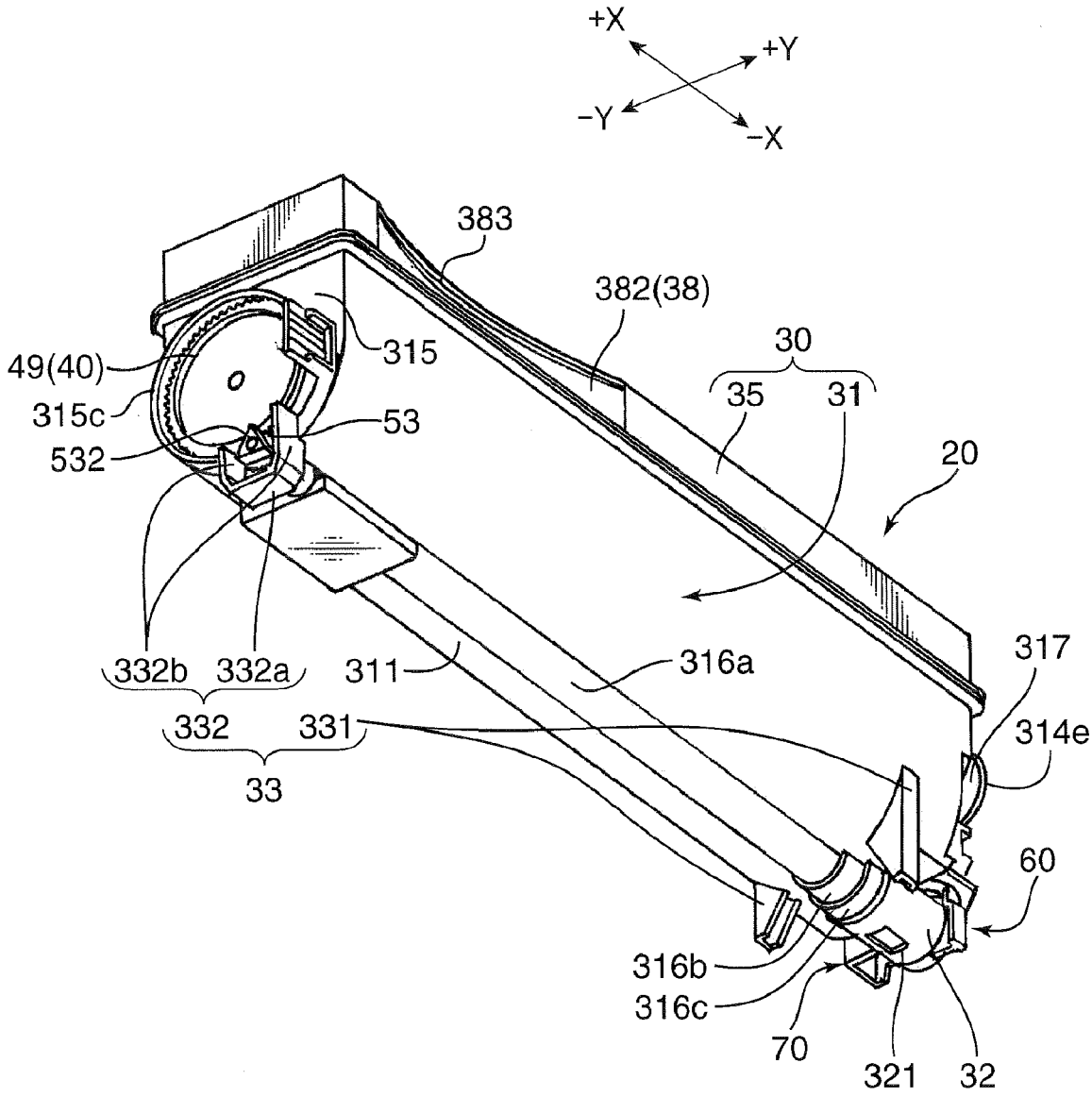
FIG. 6 is a perspective view of the toner container shown in FIG. 4 when it is viewed from an obliquely downward rear direction.
Figure 7:
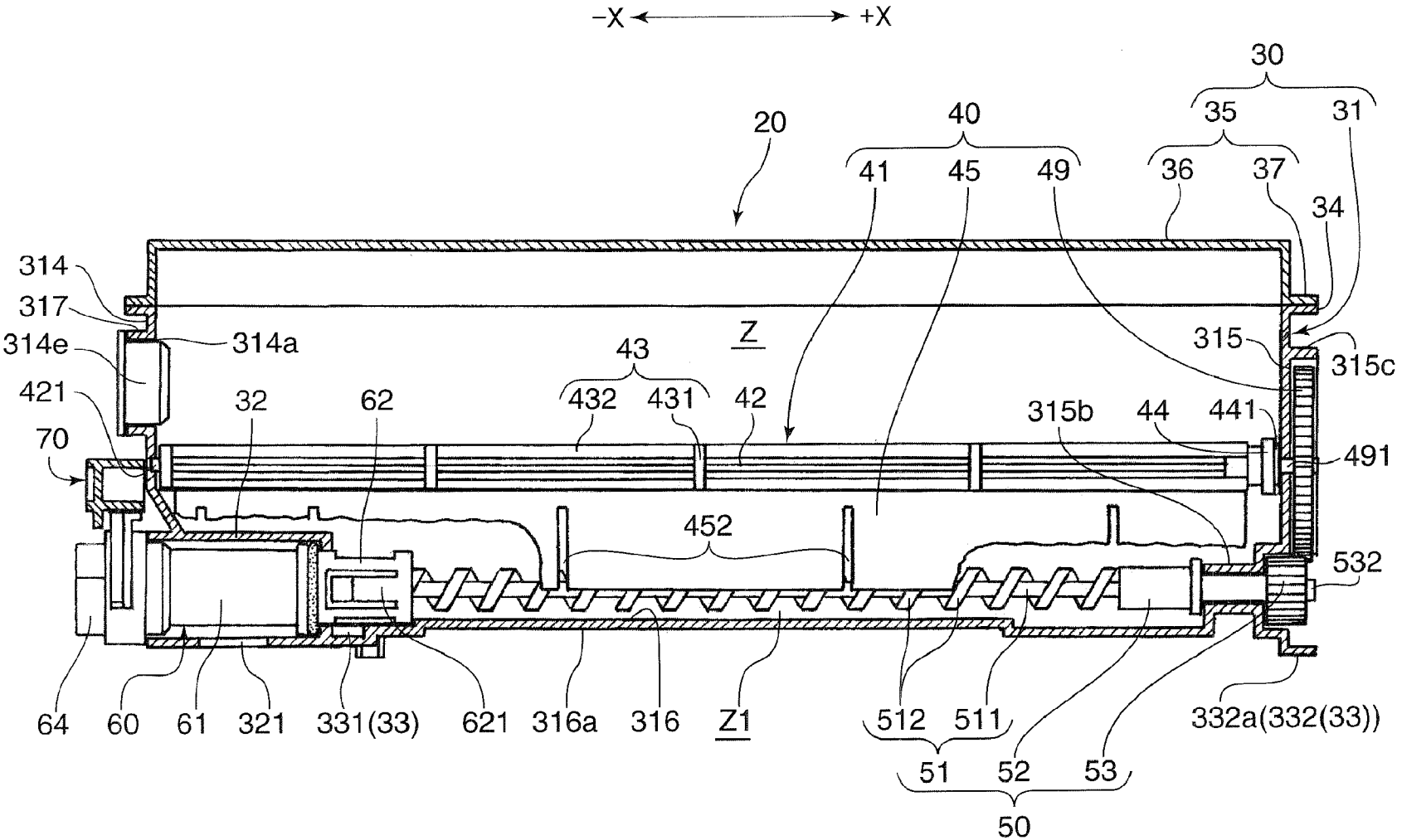
FIG. 7 is a cross sectional view of the toner container taken along line VII-VII in FIG. 5.
Figure 8:
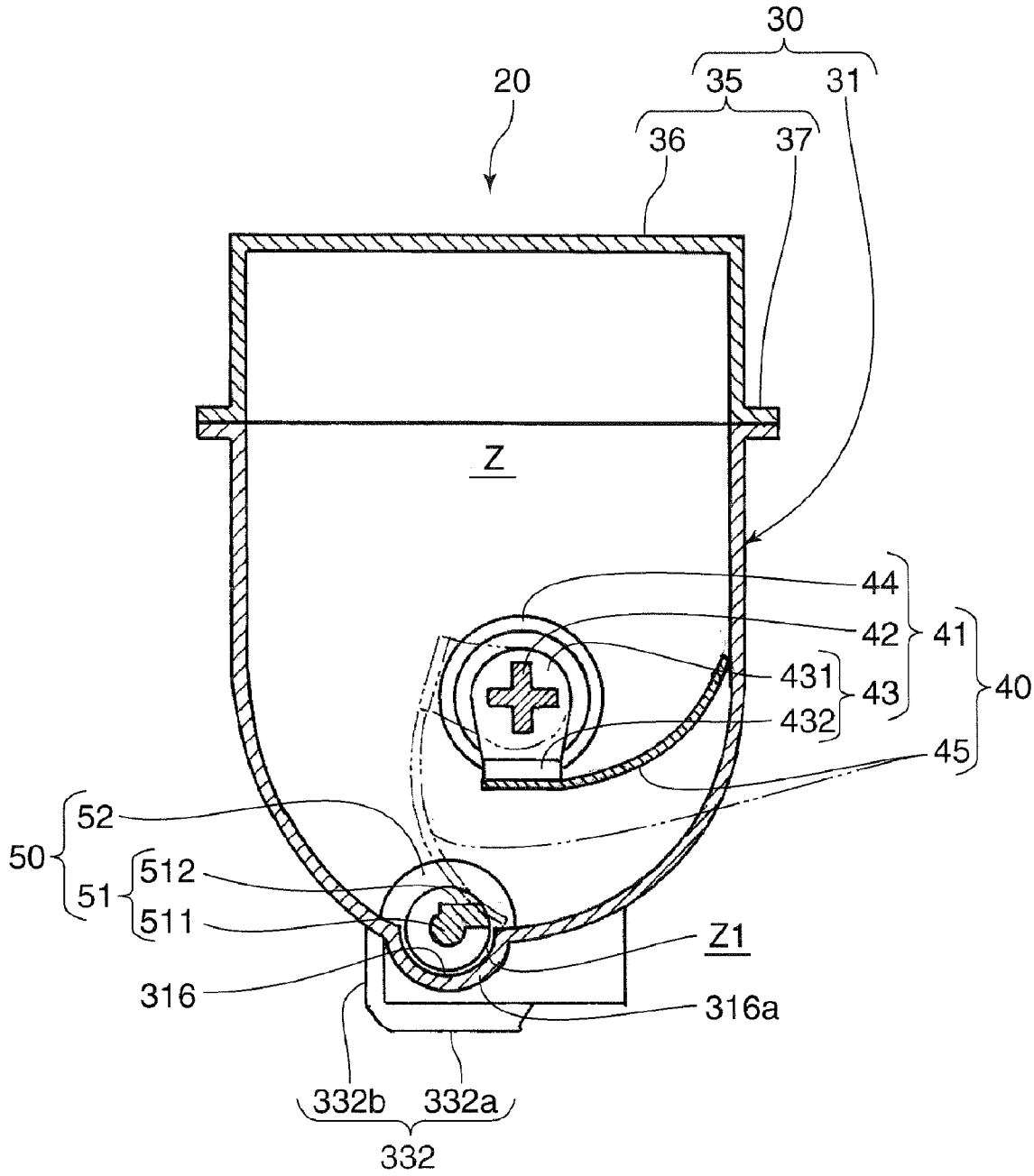
FIG. 8 is a cross sectional view of the toner container taken along line VIII-VIII in FIG. 5.

FIGS. 4, 5, and 6 are perspective views illustrating the toner container 20 according to the embodiment. FIG. 4 is a partially cut exploded perspective view of the toner container 20, and FIGS. 5 and 6 are perspective views of the assembled toner container 20. FIG. 5 is a partially cut assembly perspective view of the toner container 20 viewed obliquely from the front, and FIG. 6 is a perspective view of the toner container 20 viewed obliquely downward from the rear. FIG. 7 is a cross sectional view of the toner container taken along line VII-VII of FIG. 5. FIG. 8 is a cross sectional view of the toner container taken along line VIII-VIII of FIG. 5. In FIGS. 4 to 7, X and Y indicates the same direction as they are illustrated in FIGS. 1A and 1B, namely, X indicates the widthwise direction (−X: leftward, +X: rightward) and Y indicates the forward and backward direction (−Y: forward, +Y: backward).

Of the four toner containers 20, the magenta container 20M, the cyan container 20C, and the yellow container 20Y have the same capacities and the same specifications. On the contrary, the black container 20K has a larger capacity and a specification different from the other three. In the following description, the magenta container 20M, the cyan container 20C, and the yellow container 20Y will be described as the container 20. However, it should be noted that the black container 20K has a structure basically identical to the other three containers, except for the capacity and a specific specification.

The toner container 20 (developer replenishing device) includes: a container 30 (developer container) for containing toner (developer), the long container 30 extending in the widthwise direction; an agitator 40 for agitating toner within the container 30; a conveying member 50 for conveying toner while being agitated to supply the toner to the developing device 122; a shutter cylinder 60 capable of changing its position between the open position when the toner is conveyed by the conveying member 50 toward the developing device 122 and a closed position for controlling toner supply to the developing device 122; and a covering cap 70 for covering a left member 314 of the container 30 which will be described later.

The container 30 includes a container main body 31 of which a top surface opens almost in its entirety and a cover 35 for closing the opening on the top surface of the container main body 31. The container main body 31 includes a shutter installation cylinder 32 (cylindrical receiving section) at a left end position of a bottom of the container into which a shutter cylinder 60 is inserted from the left side to be installed therein.

The container main body 31 includes: an arc-shaped bottom portion 311 formed into a downward projecting arc-like shape; a front side portion 312 vertically extended from a front edge of the arc-shaped bottom portion 311; a rear side portion 313 extending from a rear edge of the arc-shaped bottom portion 311; a left portion 314 (first side wall) bridged between a right edge of the rear side portion 313, a right edge of the front side portion 312 and a right edge of the arc-shaped bottom portion 311; and a right portion 315 (second side wall) bridged between a left edge of the rear side portion 313, a left edge of the front side portion 312 and a left edge of the arc-shaped bottom portion 311. A space enclosed by the arc-shaped bottom portion 311, the front side portion 312, the rear side portion 313, the left portion 314, and the right portion 315 is a toner charging chamber Z to be charged with toner.

The arc-shaped bottom portion 311 is provided with a recessed screw accommodation portion 316 as shown in FIG. 7. The recessed screw accommodation portion 316 is provided such that it extends downward from a position slightly forward of a center in a frontal direction of the arc-shaped bottom portion 311 and is a recessed section extending throughout an entire length in a widthwise direction, the recessed section having an arc shape in its cross section.

An interior side of the recessed screw accommodation portion 316 is formed with a toner conveying space Z1 of a gutter-shape formed therein, and the conveying member 50 is installed in this toner conveying space Z1. The recessed screw accommodation portion 316 is formed generally into a shape with a semicircle cross section as viewed in the widthwise direction. An upper half of the toner conveyance screw 51, which will be described later, is installed in the toner conveying space Z1 projecting upward from the toner conveying space Z1 (see FIG. 7).

Since the recessed screw accommodation portion 316 is formed on the interior surface of the arc-shaped bottom portion 311, an outer surface of the arc-shaped bottom portion 311 is provided with an arc-shaped projection 316*a* having an arc-like shape in its cross section along the recessed screw accommodation portion 316. The arc-shaped projection 316*a* gives the container main body 31 an enhanced structural strength.

The left portion 314 is formed with a toner charging hole 314*a* for charging toner into the toner charging chamber Z at an upper rear position of the left portion as well as a shaft supporting cylinder 314*b* (bearing portion) for slidably receiving a center shaft 421 of an agitator 40 is provided at a position slightly forward from a position of a center of curvature of the arc-shaped bottom portion 311 such that the shaft supporting cylinder is oriented to the right.

The toner charging hole 314*a* is defined and enclosed by a toner charging cylinder 317. This toner charging cylinder 317 receives a synthetic resin stopper member 314*e* after toner is charged in a container main body 31.

Figure 9:
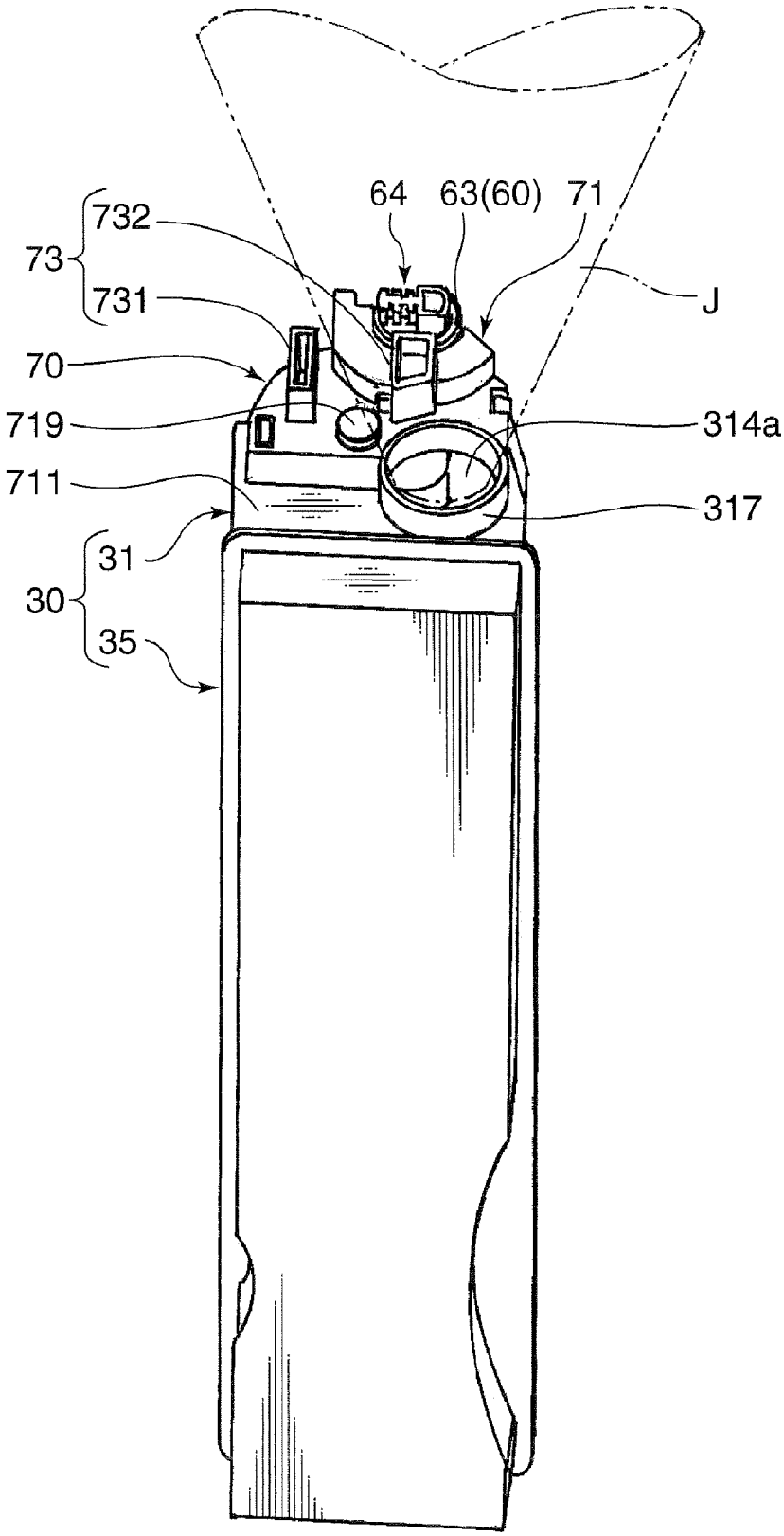
FIG. 9 is a perspective view showing a toner charging operation in the toner container.

FIG. 9 is a perspective view illustrating a toner charging operation for the toner container 20. As shown in FIG. 9, upon charging toner in the toner container 20, the toner container 20 is erected with the side of the driving members (the right portion 315 side where the agitating gear 49 and the conveying gear 53 are provided) facing downward, such that the operation side including the left portion 314 and an operation lever 642 facing upward. In the above described position, a tip of the funnel J is inserted into the toner charging hole 314*a* to charge toner into the toner container 20 through the funnel J.

The toner charging hole 314*a* is provided in the left portion 314 for the following reasons. Namely, the toner container 20 is attached to and detached from the container accommodation chamber Q of the apparatus main body 11 from above in the present embodiment. In the case where the cylindrical toner charging hole 314*a* is formed in a surface along the attachment and detachment direction (front side portion 312 and rear side portion 313), a projection comes to being over the surface along the attachment and detachment direction in the state where the stopper member 314*e* seals the toner charging hole 314*a*, and consequently obstructs the attachment and detachment of the toner container 20.

Also, since the toner container 20 extends in the widthwise direction, it is more advantageous in charging efficiency to charge toner from a side surface in the widthwise direction. Further, because the right portion 315 serving as driving force transmission is provided with an agitating gear 49 and the conveying gear 53, there is not a sufficient space for the toner charging hole 314*a* therein. Accordingly, the toner charging hole 314*a* having a large diameter suitable for high-speed toner charging is formed in the left portion 314 of an operation side having a sufficient space.

The toner charging hole 314*a* is provided at a convenient position at an upper rear of the shaft supporting cylinder 314*b* as a bearing portion for supporting one end of the agitating shaft (actually, a sheath cylinder 719 described below is externally engaged with the shaft supporting cylinder 314*b* with the covering cap 70 being mounted to the container main body 31). Accordingly, the shaft supporting cylinder 314*b* is positioned between the toner charging hole 314*a* and a forward swing prevention projection 731 which will be described later.

Since the toner charging hole 314*a* is formed in the left portion 314 at the above described position, the toner charging funnel J does not interfere with the other members on the left portion 314 (covering cap 70 and forward swing prevention projection 731). Therefore, the toner charging operation through the toner charging hole 314*a* can be carried out smoothly.

This charging operation is executed in a posture of standing the toner container 20 in such a manner that the toner charging hole 314*a* is in an upper position. A toner discharge hole 321, which is to be described later, is formed near the left portion 314 of the container main body 31. In other words, the toner charging hole 314*a* and the toner discharge hole 321 are provided close to each other. Accordingly, the likelihood that toner spills over the toner container 20 in the course of being carried to users from a factory can be assuredly eliminated by packaging the toner container 20 in the standing posture after being charged with toner by a level not higher than the toner discharge hole 321 in the standing posture.

The left portion 314 is provided with a retaining projection (i.e., engagement projection) 314*d* and a retaining claw portion (i.e., engagement claw portion) 314*c*, respectively, for retaining the covering cap 70 at a rear end position slightly upward from center in a vertical direction and at a front end position slightly downward from center in a vertical direction.

The left portion 314 is provided with a shutter installation cylinder 32 for receiving a shutter cylinder 60, the shutter installation cylinder projecting rightward at a position lower than the retaining claw portion 314*d* and concentrically with the center of curvature of the recessed screw accommodation portion 316.

The arc-shaped bottom portion 311 is provided with a supporting leg 33 for supporting the container 30 on the partition 18 (FIG. 2). The supporting leg 33 includes, as shown in FIG. 6, a pair of left legs 331 in the frontal direction which project downward from an appropriate right position of the arc-shaped bottom portion 311, and one right leg (covering member) 332 provided at a bottom left end of the arc-shaped bottom portion 311.

The right leg 332 serves as a positioning member in the toner charging chamber Z and as a protector of a conveyance gear (driving force transmitting portion) 53 which will be described below, and is provided such that it project downward and leftward at a position corresponding to the recessed screw accommodation portion 316. Such a right leg 332 includes a horizontal small portion 332*a* and front and rear vertical small portions 332*b* vertically extending from the front and rear ends of the horizontal small portion 332*a* respectively. The conveying gear 53 is housed and protected in an enclosed space by the horizontal small portion 332*a* and the pair of vertical small portions 332*b*.

The right leg 332 is formed such that a bottom surface of the horizontal small portion 332*a* abuts and is in flush with a plane identical to each of the bottom ends of the pair of left legs 331. Accordingly, the container main body 31 is supported in three points by the supporting legs 33 such that the toner container 20 is placed on the partition 18 of the apparatus main body 11, whereby an entire bottom surface of the horizontal small portion 332*a* abuts the partition 18.

On the other hand, on the side bearing the driving members (right side) of the apparatus main body 11 that convey a driving force to the conveying member 50, a wall surface of a right wall within the container accommodation chamber Q is provided with positioning grooves 101 corresponding to the respective right legs 332 of each of the toner containers 20 as shown in FIG. 2B. When the toner container 20 is installed in the container accommodation chamber Q, the right leg 332 is engaged in the corresponding positioning groove 101. In this state, the toner container 20 is moved down and installed into the container accommodation chamber Q with the guidance of the positioning grooves 101.

Further, on the operation side (left side) at which the shutter cylinder 60 of the toner container 20 of the apparatus main body 11 is operated, a left wall of the toner charging chamber Z is provided with recessed support portions 102 for supporting the shutter installation cylinders 32 of the toner containers 20, respectively, as shown in FIG. 2B. Each recessed support portion 102 corresponds to the guide groove 81 of the partition wall (FIG. 19A) which has the below described feature of the present embodiment.

When the toner container 20 is installed into the container accommodation chamber Q, the toner container 20 is moved downward to insert the shutter installation cylinder 32 into the wide portion of the upper section of the recessed support portion 102 after the right leg 332 is engaged with the corresponding positioning groove 101. Accordingly, the toner container 20 is kept moving downward with the guidance of the positioning groove 101 to reach the partition 18, and thereby the shutter installation cylinder 32 is installed into the container accommodation chamber Q with the shutter installation cylinder 32 being engaged with the recessed support portion 102.

As stated above, the right leg 332 also serves as a supporting leg 33 to protect the conveying gear 53 and to position the toner container 20, thus eliminating the necessity of a dedicated protection member and a dedicated positioning member for the conveying gear 53 and helping to reduce the number of parts.

The right portion 315 is provided with a shaft supporting hole 315*a* opposite to the shaft supporting cylinder 314*b* in the widthwise direction. The shaft supporting hole 315*a* is provided for inserting a coupling shaft 491 of the agitating gear 49, which will be described later, from an outer side of the right portion 315. The agitator 40 is supported at a right end of the agitator in an integrally rotatable manner. The right portion 315 is provided with a gear installation cylinder 315*b* at a rear bottom of the shaft supporting hole 315*a* that extends toward the toner charging chamber Z. This gear installation cylinder 315*b* receives generally a half of the thickness of the conveying gear 53, which will be described below. A partitioning wall provided on a left end surface of the gear installation cylinder 315*b* is provided with the shaft supporting hole 315*d* for supporting the coupling shaft 531 of the conveying gear 53, which will be described later.

The outer surface of the right portion 315 is, as shown in FIG. 6, provided with an annular strip 315*c* concentric with a the shaft supporting hole 315*a* in order to protect the agitating gear 49 which will be described later. This annular strip 315*c* is provided with a notch at a portion of the annular strip corresponding to the right leg 332, and thus this notch provides a spatial relationship between a space encircled by the annular strip 315*c* and an inside of the right leg 332.

Turning back to FIG. 4, the cover 35 closes the top opening of the container main body 31 and has a shape identical to the container main body 31 when viewed on a plane. The cover 35 includes a cover main body 36 having an opening over its entire lower surface and a cover side flange 37 projecting outward from the lower edge of this cover main body 36 over the entire peripheral.

On the other hand, the container main body 31 includes a main body side flange 34 projecting from a leading edge over the entire peripheral so as to be opposed to the cover side flange 37. Opposing surfaces of the flanges 34 and 37 are bonded to each other with a predetermined gluing or adhesion process, and thereby the cover 35 is fixedly attached to the container main body 31.

The cover main body 36 is provided with concave handles 38 at appropriate positions of front and rear sides extending in a widthwise direction (rightward position of the present embodiment). These concave handles 38 are formed such that the front and the rear sides of the cover main body 36 are recessed into mutually opposing arcs. In the present embodiment, the small concave handle 381 capable of receiving a thumb is formed on the front side of the cover main body 36, whereas a large concave handle 382 capable of receiving an index finger, a middle finger, a ring finger, or a little finger is formed on the rear side of the cover main body opposing to the small concave handle 381.

Vertical dimensions of the cover 35 are set such that the cover 35 can be held by at least fingers (about 10 mm in the present embodiment). Accordingly, the user can stably hold the cover 35 and carry the toner container 20.

Leading edges of the concave handle 38 (small concave handle 381 and large concave handle 382) are provided with hooking flanges 383 extending outward for entire lengths of the concave handle, as shown in FIG. 6. The hooking flanges 383 catch on fingers when the small concave handle 381 and the large concave handle 382 are held. Thus, such an inconvenience of slipping fingers can be eliminated so that the user can hold the cover 35 securely.

Figure 10:
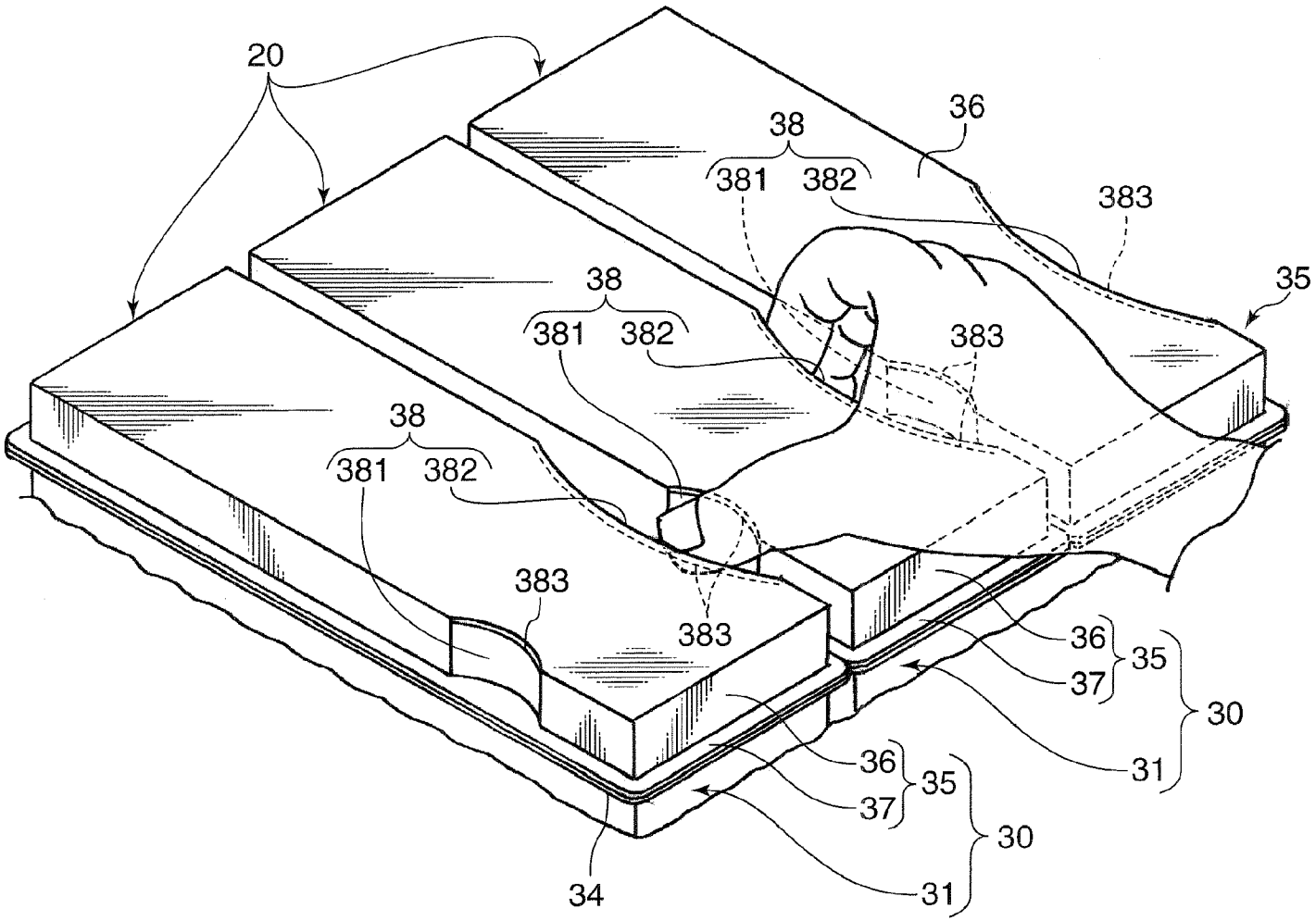
FIG. 10 is a perspective view illustrating a user holding the toner container.

FIG. 10 is a perspective view illustrating the user holding the toner container 20. The toner container 20 is held up by inserting a thumb into the smaller concave handle 381 as well as inserting the index, middle, ring, and little fingers to the larger concave handle 382 to hold the concave handle 38 as shown in FIG. 10. The concave handles 38 are provided at positions shifted to a side of the right portion 315 extending in the widthwise direction from a center of the container 30 in a longitudinal direction. Therefore, if the user lifts the toner container 20 upward in this state, only a less force is required in terms of moment at the start of lifting the toner container 20 since it is lifted from one side of the toner container. Accordingly, the toner container 20 can be pulled upward from the container accommodation chamber Q of the printer 10.

Now, turning back to FIG. 4, the agitator 40 is provided for agitating the toner within the container main body 31. The agitator 40 includes a shaft member 41 which is bridged between the shaft supporting cylinder 314*b* provided on the left portion 314 of the container main body 31 and the shaft supporting hole 315*a* provided in the right portion 315 of the container main body 31; the agitating blade 45 mounted on the shaft member 41; and the agitating gear 49 coupled to the shaft member 41 concentrically in an integrally rotatable manner.

The shaft member 41 is set to be slightly shorter than a distance between the left portion 314 and the right portion 315. The shaft member 41 includes a joint cross (agitating shaft) 42 having a cross shape in a cross sectional view, a plurality of blade supporting members 43 fit into this joint cross 42, and a joint disc 44 fixed concentrically to a right end of the joint cross 42.

Each blade supporting member 43 includes a fitting portion 431 fitted to the joint cross 42 and a blade receiving portion 432 extending from an edge of this fitting portion 431 so as to be parallel with the joint cross 42. In the present embodiment, it is exemplified that four blade supporting members 43 are used and the fitting portions 431 of the four blade supporting members 43 are fitted to the joint cross 42 with equal pitches in an integrally rotatable manner. The joint cross 42 has a central shaft 421 concentric with the joint cross 42. The central shaft 421 passes through the leftmost fitting portion 431 at the left end surface of the joint cross 42 to project further leftward. The central shaft 421 is fit into the shaft supporting cylinder 314*b* of the left portion 314.

A joint disc 44 is coupled to the agitating gear 49 through the shaft supporting hole 315*a* in a manner concentrically with and integrally rotatable with the agitating gear. The rotation of the agitating gear 49 is conveyed to the shaft member 41 through the joint disc 44.

The agitating gear 49 includes at its central position a coupling shaft 491 projecting to the left. This coupling shaft 491 has a diameter slightly smaller than that of the shaft supporting hole 315*a* and is fit into the shaft supporting hole 315*a* in a slidable manner. A leading end of the coupling shaft 491 is provided with a key projection. On the other hand, a right surface of the joint disc 44 includes a key hole corresponding to the key projection. When the key projection is fit into the keyhole, the agitating gear 49 can be rotatable together with the shaft member 41 around an axial direction thereof, thereby conveying the rotation of the agitating gear 49 to the shaft member 41.

The shaft member 41 and the agitating gear 49 are coupled to each other by an annular sealing member 441 disposed between the right portion 315 and the joint disc 44 as shown in FIG. 7. Owing to the annular sealing member 441, the toner within the container main body 31 is prevented from leaking through the shaft supporting hole 315*a*.

The agitating blade 45 is fixedly attached to the blade receiving portions 432 of the joint cross 42 at an edge of a longer side of the agitating blade in order to agitate the toner, and is made of a flexible synthetic resin film. The agitating blade 45 is given a length identical to that of the joint cross 42 and a width (diameter of the joint cross 42) slightly longer than a distance between an axis of the joint cross 42 and an interior surface of the arc-shaped bottom portion 311 of the container main body 31.

The agitating blade 45 is formed with a predetermined number of small holes 451 along the edge of a longer side of the agitating blade at equal pitches in order to install the agitating blade 45 to the blade receiving portion 432. The blade receiving portion 432 includes threaded screw holes 433 at positions corresponding to the small holes 451. A predetermined screw is screwed and secured into the corresponding screw hole 433 through the corresponding small hole 451, thereby mounting the agitating blade 45 to the shaft member 41.

The agitating blade 45 is provided with a plurality of cut grooves 452. The cut grooves 452 are formed such that the agitating blade 45 is cut in its width direction toward the base end from an edge opposite to a base side where the small holes 451 are provided.

The shaft member 41 is rotated in a clockwise direction in FIG. 8 with the shaft member 41 mounted in the toner charging chamber Z of the container main body 31, thereby allowing the agitating blade 45 to come into contact with the interior surface of the arc-shaped bottom portion 311 while the agitating blade is curved according to elastic deformation. The agitator 40 agitates the toner within the toner charging chamber Z such that the toner adhered to the interior surface of the arc-shaped bottom portion 311 is scraped out by the contact by the agitating blade 45.

Figure 11:
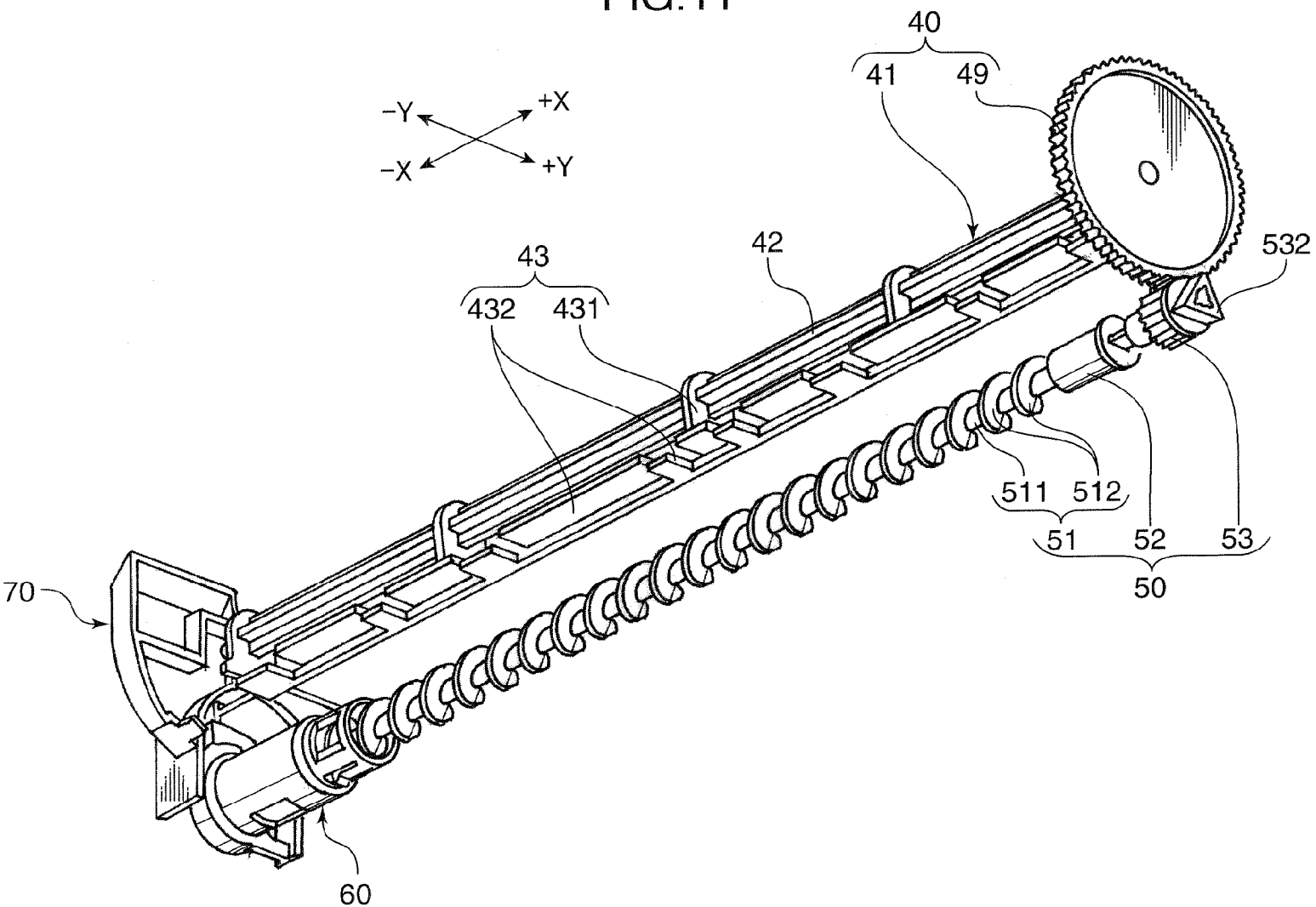
FIG. 11 is a perspective view of an agitator and a conveying member viewed from an obliquely right front direction focusing on a relative positional relation between the two.

The conveying member 50 will now be described with reference to mainly FIGS. 4 and 11, and to the other drawings, if required. FIG. 11 is a perspective view of the agitator 40 and the conveying member 50 viewed obliquely from a right front direction and focused on the relative positional relation therebetween. In FIG. 11, directions indicated by X and Y are identical to those in FIG. 1, namely, X indicates a widthwise direction (−X: leftward and +X: rightward) and Y indicates a forward and backward direction (−Y: forward, +Y: backward).

The conveying member 50 conveys toner to the shutter cylinder 60 along the toner conveying space Z1 of the recessed screw accommodation portion 316 provided on the arc-shaped bottom portion 311 of the container main body 31 in preparation of agitation by the agitator 40.

The conveying member 50 includes a toner conveyance screw 51 arranged along the toner conveying space Z1 of the recessed screw accommodation portion 316, a cylindrical body 52 extending integrally with the toner conveyance screw 51 concentrically from a right end of the toner conveyance screw, and the conveying gear 53 mounted concentrically to this cylindrical body 52.

The toner conveyance screw 51 includes a screw shaft 511 extending in a widthwise direction and a plurality of agitating fins (spiral blades) 512 which are integrally fit into the screw shaft 511 at equal pitches. Each of the agitating fins 512 is mounted to the screw shaft 511 almost throughout the entire length of the screw shaft 511 such that the agitating fins 512 are linked to each other to form a spiral shape. A left end of the screw shaft 511 is supported by the shutter cylinder 60 installed in the shutter installation cylinder 32 provided on the left portion 314 so as to be concentric to the shutter cylinder in a relatively rotatable manner.

The agitating fin 512 is not provided on a portion of the screw shaft 511 corresponding to the toner discharge hole 321 of the shutter installation cylinder 32 which is described later. Instead thereof, at least one projecting rib that is not shown is provided in parallel to the screw shaft 511, and a leading end (left end) of the screw shaft 511 is provided with the agitating fins 512 and a reverse spiral agitating fin 513 of which the spiral direction is opposite to that of the agitating fins 512. Therefore, the toner that reaches the toner discharge hole 321 by a driving force of the toner conveyance screw 51 is forwarded to the toner discharge hole 321 by means of the agitating fins 512 and the reverse spiral agitating fin 513, thereby allowing a smooth discharge of toner through the toner discharge hole 321.

The cylindrical body 52 conveys driving rotation of the conveying gear 53 to the toner conveyance screw 51 and includes the concentric key hole in the right end surface of the cylindrical body. The cylindrical body 52 is coupled to the conveying gear 53 installed in the gear installation cylinder 315*b* in a concentrically integrally rotatable manner.

The conveying gear 53 rotates owing to a driving force from a not-shown driving motor provided at an appropriate position within the apparatus main body 11. The rotation of the conveying gear 53 is directly conveyed to the toner conveyance screw 51 as well as conveyed to the shaft member 41 of the agitator 40 through the agitating gear 49. The conveying gear 53 is placed within an interior space of the right leg 332 and meshes with the agitating gear 49.

A left surface of the conveying gear 53 is provided with a coupling shaft 531 which is concentrically projected to the left and which is inserted into the shaft supporting hole 315*d* to be coupled to the cylindrical body 52. A right surface of the conveying gear 53 is provided with a triangular joint projection 532 for conveying a driving force of the driving motor (see also FIG. 6).

A front end surface (left surface) of the coupling shaft 531 is concentrically provided with the key projection, while a right end surface of the cylindrical body 52 is formed with the key hole corresponding to the key projection. Since the key projection is fit into the key hole, the drive rotation of the conveying gear 53 is conveyed to the toner conveyance screw 51 through the cylindrical body 52.

About an upper half of the toner conveyance screw 51 projects upward from the toner conveying space Z1, as shown in FIG. 8, when the toner conveyance screw 51 is installed in the recessed screw accommodation portion 31 within the container main body 31 (i.e., within the toner conveying space Z1). On the other hand, the agitating blade 45 is dimensioned such that it elastically deforms to curve when a leading edge of the agitating blade comes into sliding contact with an interior surface of the arc-shaped bottom portion 311.

Therefore, when the agitator 40 integrally rotates around the shaft member 41 in a clockwise direction in FIG. 8, the leading end of the agitating blade 45 will stroke an upper surface of the toner conveyance screw 51 as shown by an alternating long and two dashed line in FIG. 8. This prevents a phenomenon known as bridging wherein toner accumulates on an upper position of the toner conveyance screw 51 and thus consistently and reliably supplies the toner from the toner charging chamber Z.

In other words, if a depth of the toner conveying space Z1 is larger than a radial length (diameter) of the toner conveyance screw 51 and if the curve of the agitating blade 45 is not large as in prior art, the leading end of the agitating blade 45 cannot come into contact with the peripheral surface of the toner conveyance screw 51 and only passes through an upper surface opening of the recessed screw accommodation portion 31 in a frictional manner. This works as a force for compressing the toner residing in the recessed screw accommodation portion 316. Accordingly, the bridging phenomenon occurs wherein the toner accumulates and creates a tunnel-like sealing at a portion of the top surface opening of the recessed screw accommodation portion 316, and therefore the toner cannot be appropriately replenished in the developing device 122. However, such an inconvenience is reliably prevented by setting the depth of the recessed screw accommodation portion 316 so that the upper half of the toner conveyance screw 51 projects to consistently come into contact with the leading end of the agitating blade 45.

Figure 12A:
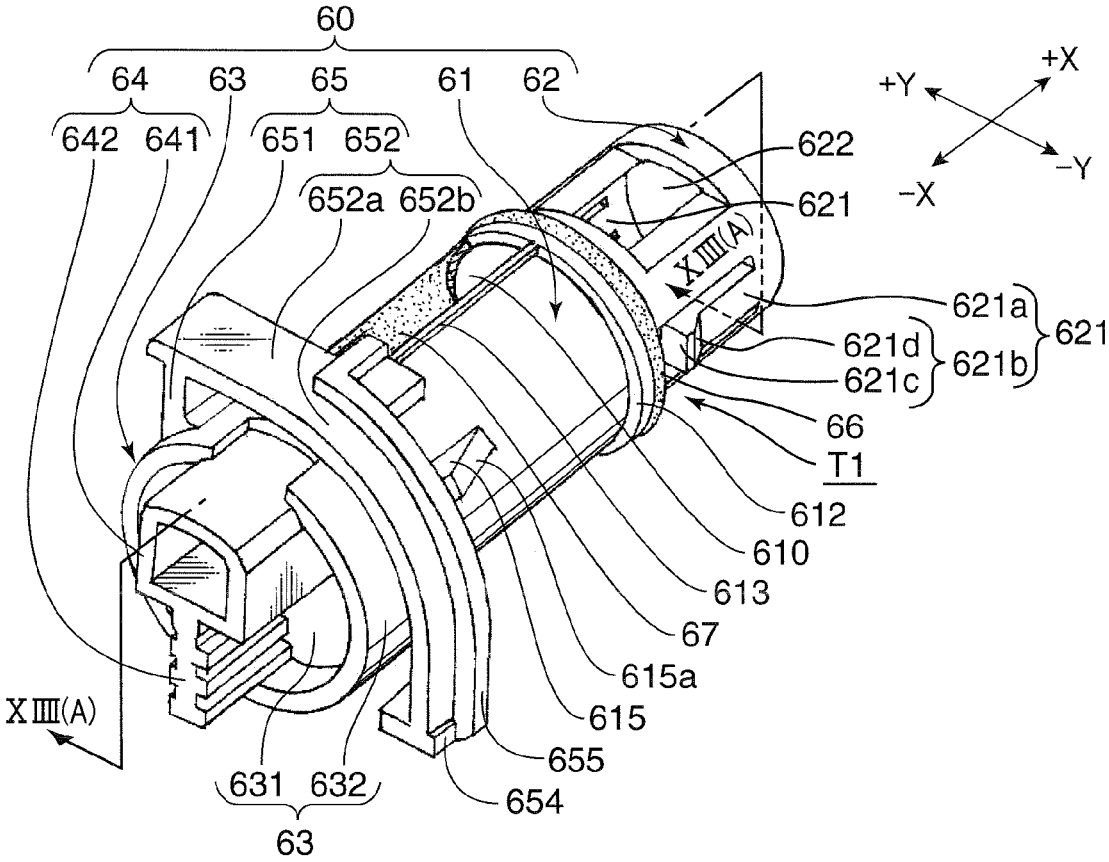
FIGS. 12A and 12B are partially cut perspective views each illustrating a shutter cylinder, showing a state where the shutter cylinder is in a closed position.
Figure 12B:
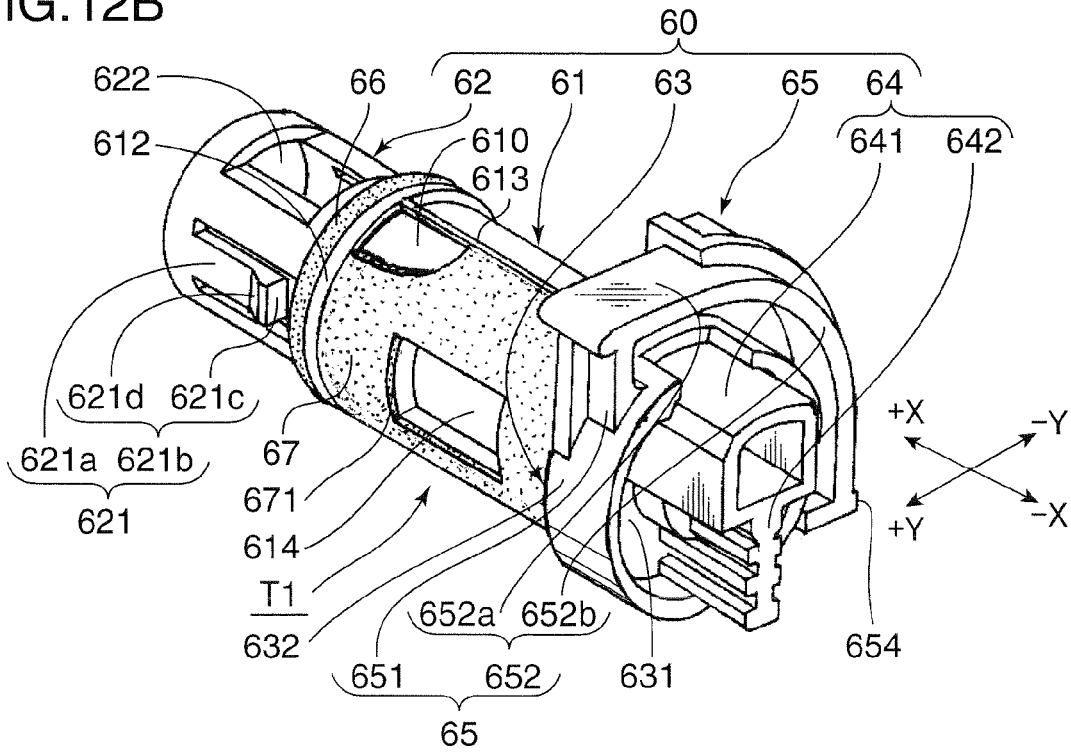
Figure 13A:
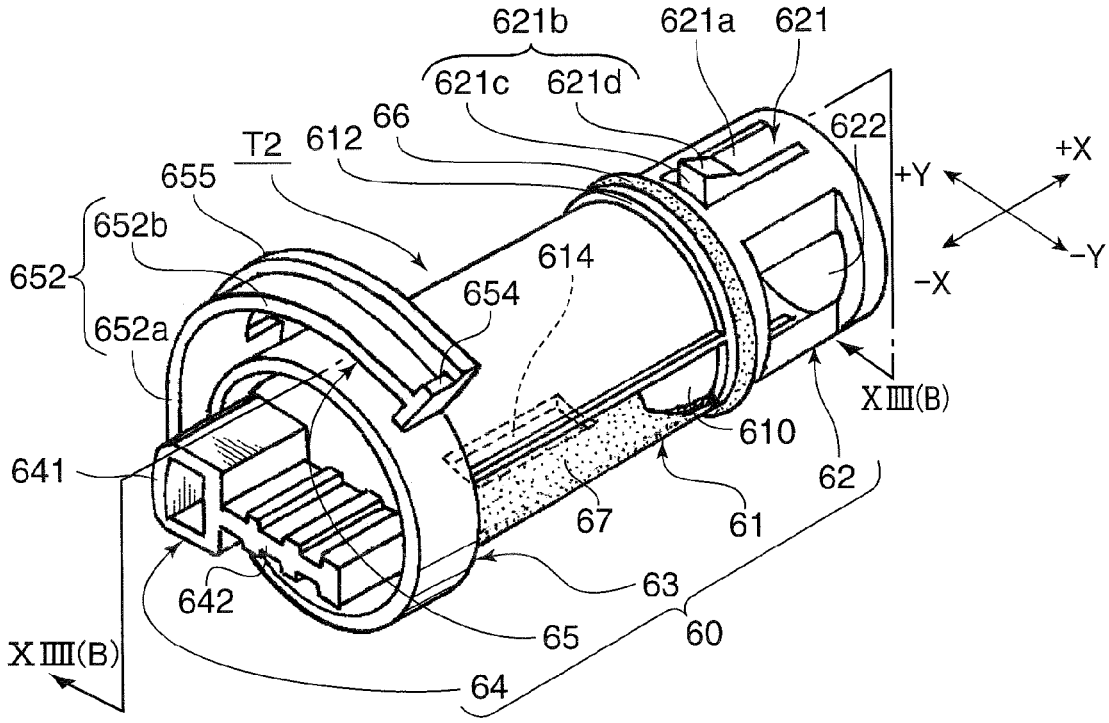
FIGS. 13A and 13B are perspective views each illustrating a state where the shutter cylinder is in an open position.
Figure 13B:
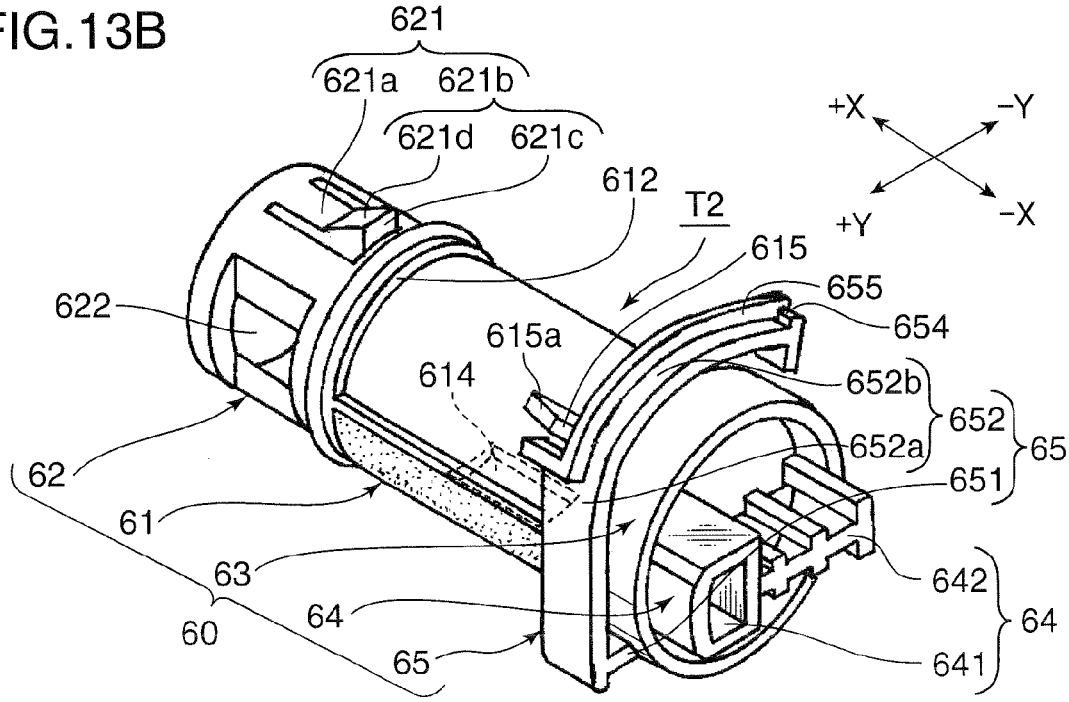

A shutter cylinder 60 will now be described with reference to FIG. 4 and FIGS. 12A through 15 and other drawings as necessary. FIGS. 12A through 13B are partially cut perspective views illustrating the shutter cylinder 60. FIGS. 12A and 12B illustrate the shutter cylinder 60 in a closed position T1. FIGS. 13A and 13B illustrate the shutter cylinder 60 in an open position T2. FIGS. 12A and 13A are views of the shutter cylinder from a left front direction, and FIGS. 12B and 13B are views of the shutter cylinder from a left rear direction.

Figure 14A:
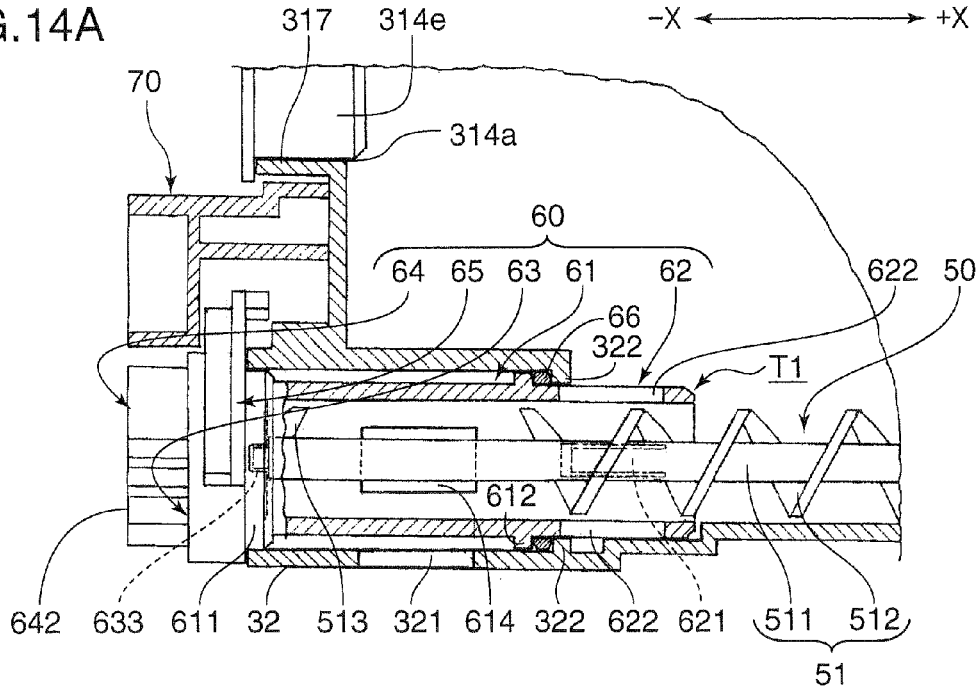
FIG. 14A is a cross sectional view of the shutter cylinder taken along line XIIII(A)-XIIII(A) in FIG. 12A.
Figure 14B:
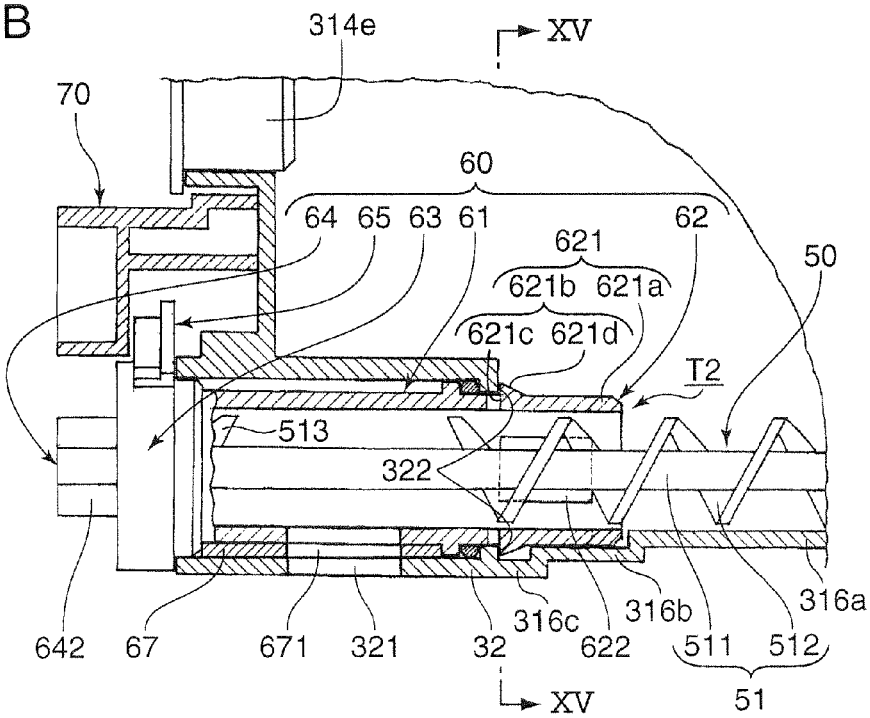
FIG. 14B is a cross sectional view of the shutter cylinder taken along line XIIII(B)-XIIII(B) in FIG. 13A.
Figure 15:
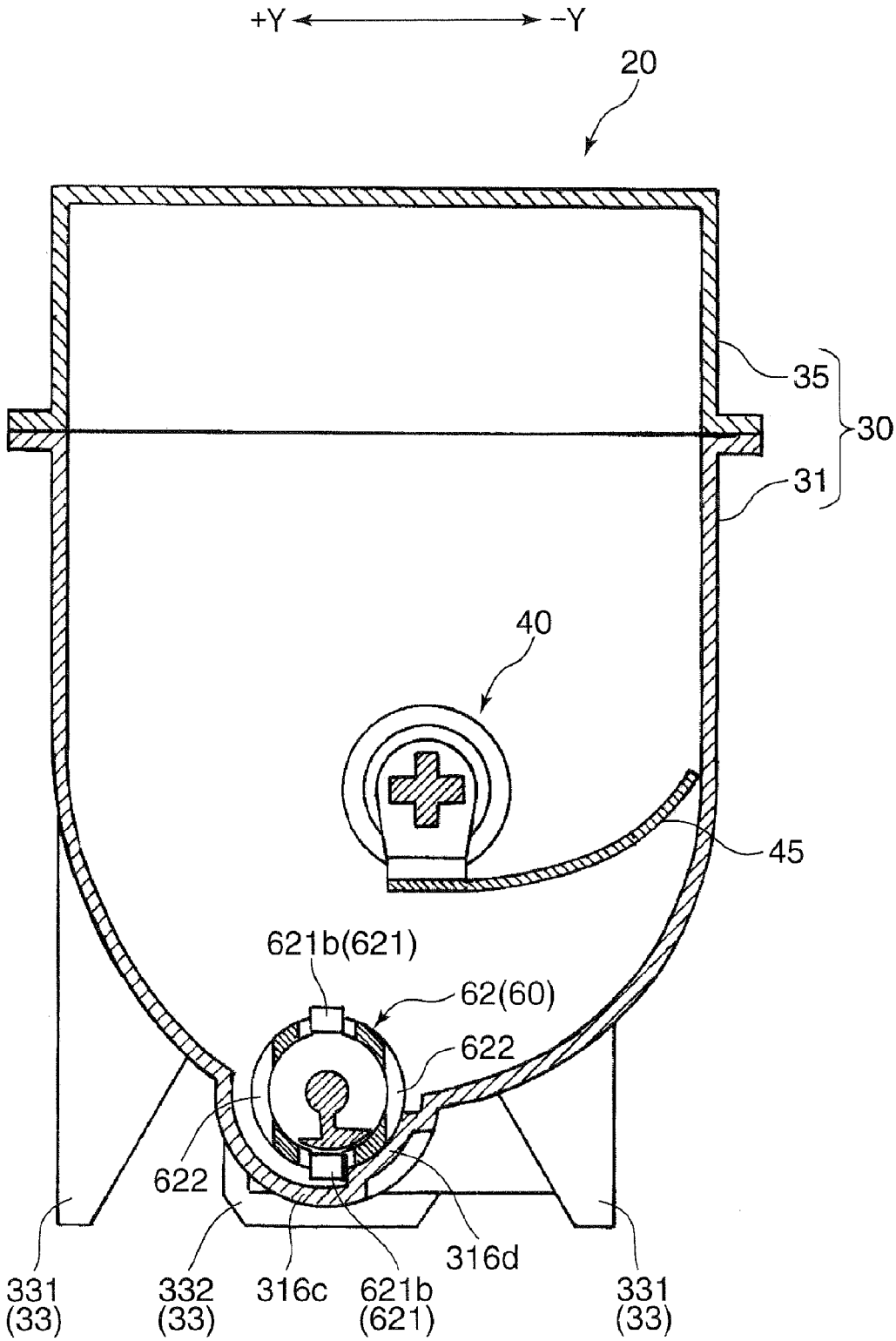
FIG. 15 is a cross sectional view of the shutter cylinder taken along line XV-XV in FIG. 14B.

FIG. 14A is a cross sectional view of the shutter cylinder taken along line XIIII(A)-XIIII(A) in FIG. 12A. FIG. 14B is a cross sectional view of the shutter cylinder taken along line XIIII(B)-XIIII(B) in FIG. 13A. FIG. 15 is a cross sectional view of the shutter cylinder taken along line XV-XV in FIG. 14B. In FIGS. 14A, 14B, and 15, adjacent members such as the shutter installation cylinder 32 and the toner conveyance screw 51 and the like are also illustrated. Directional indication by X and Y in FIGS. 12A to 15 is identical to those in FIGS. 1A and 1B, namely, X indicates a widthwise direction (−X: leftward, +X: rightward) and Y indicates a forward and backward direction (−Y: forward, +Y: backward).

The shutter cylinder 60 is generally made of a cylindrical body and is rotated around the cylinder axis in a clockwise direction and a counterclockwise direction. The shutter cylinder 60 is installed in the shutter installation cylinder 32 (FIG. 4) of the container main body 31, thereby allowing the shutter cylinder to change its position between the open position T2 to replenish the developing device 122 of FIG. 3 with toner conveyed by the conveying member 50, and the closed position T1 disabling the replenishing operation. The left end of the screw shaft 511 of the toner conveyance screw 51 is supported by the shutter cylinder 60 concentrically and relatively rotatable around the shaft center while the shutter cylinder 60 is fit into the shutter installation cylinder 32 as shown in FIG. 7.

The shutter cylinder 60 includes a shutter cylinder body 61, a cylindrical retaining body (cylindrical leading portion) 62, a circular closure 63, an operating portion 64, a locking member 65, and a ring-shaped seal (annular sealing member) 66. The shutter cylinder body 61 has a cylindrical body to be inserted into the shutter cylinder 32 of the container main body 31. The cylindrical retaining body 62, extended concentrically rightward from a leading end (right end) of the shutter cylinder body 61, is a member for retaining the shutter cylinder body 61 in the shutter installation cylinder 32. The circular closure 63 is provided at a base end (left end) of the shutter cylinder body 61 and has a diameter larger than that of the shutter cylinder body 61. The operating portion 64, extending from a left end surface of the circular closure 63 to the left, is a member for allowing the shutter cylinder body 61 to rotate. The locking member 65, projecting from a peripheral surface of the circular closure 63, is a member for locking a setting position such as closed position T1 or the open position T2 of the shutter cylinder 60. The ring-shaped seal 66 is an elastic sealing member fit into a periphery between the shutter cylinder body 61 and the cylindrical retaining body 62.

On the other hand, the shutter installation cylinder 32 is given a slightly longer length in its widthwise direction than a length of the shutter cylinder body 61 as shown in FIGS. 14A and 14B. The shutter cylinder 60 is inserted into the shutter installation cylinder 32 from a left end opening of the shutter installation cylinder 32 and then the circular closure 63 is fixedly attached to the left edge of the shutter installation cylinder 32. In the above insertion state, the shutter cylinder body 61 is housed within the shutter installation cylinder 32, and the cylindrical retaining body 62 projects rightward from the shutter installation cylinder 32 to be positioned in the toner conveying space Z1 of the container main body 31.

The shutter installation cylinder 32 is given an inner diameter slightly larger than the outer diameter of the shutter cylinder body 61. Also, a leading end (right end) of the shutter installation cylinder 32 is provided with an annular projection (first retaining portion) 322 concentrically projecting to the interior. An interior peripheral surface of this annular projection 322 is able to come into sliding contact with an exterior peripheral surface of the cylindrical retaining body 62.

The shutter cylinder body 61 is given an inner diameter slightly larger than the outer diameter of the agitating fin 512 such that the agitating fin 512 can be inserted into the shutter cylinder body 61. A base end (left end) of the shutter cylinder body 61 is concentrically provided with a base end flange 611. A leading end (right end) of the shutter cylinder body is provided with a leading end flange 612. The flanges 611 and 612 have outer diameters such that an outer peripheral surface thereof comes into sliding contact with an inner peripheral surface of the shutter installation cylinder 32.

A peripheral surface of the shutter cylinder body 61 is provided with a pair of ribs 613 bridged between the flange 611 and the flange 612 at point-wise symmetric positions with regard to the cylinder axis. One peripheral surface of the shutter cylinder body 61 between a pair of ribs 613 includes a toner discharge opening 614 at a central position of the shutter cylinder body which extends in a widthwise direction and has a rectangular shape when viewed from a radial direction.

One side (reduced portion) 610 of the shutter cylinder body 61 including the toner discharge opening 614 is provided with a sponge-like seal pad 67 adhered thereto. The seal pad 67 may be made of any synthetic resin-made foam. Specifically, a suitable example of the sealing pad includes a high density microcell urethane sheet. Such a seal pad 67 is provided with a corner hole 671 of the same shape as the toner discharge opening 614 and at a position corresponding to the toner discharge opening.

The shutter installation cylinder 32 is formed with a toner discharge hole 321 at a position opposite to the toner discharge opening 614. Therefore, the toner within the shutter cylinder body 61 is replenished into the developing device 122 through the toner discharge opening 614, the corner hole 671, and the toner discharge portion 321 by a driving force of the conveying member 50 such that the toner is prevented from leaking to the outside by the seal pad 67 when the shutter cylinder 60 is set to an open position T2.

A peripheral surface of the shutter cylinder body 61, namely, a peripheral surface opposite to a peripheral surface formed with the toner discharge opening 614, is provided with a guide rib 615 extending rightward from the base end flange 611. This guide rib 615 is provided in order to make it easy to insert the shutter cylinder 60 into the shutter installation cylinder 32. The guide rib 615 is given a length in the width direction equal to or less than a half of a length of the shutter cylinder body 61 and a thickness in a radial direction slightly smaller than a thickness of the base end flange 611.

A leading end (right end) of the guide rib 615 is provided with an inclined surface 615*a* inclining to a peripheral surface of the shutter cylinder body 61. Therefore, when the shutter cylinder 60 is inserted into the shutter installation cylinder 32, the inclined surface 615*a* of the guide rib 615 comes into contact with a left edge of the shutter installation cylinder 32, thereafter to be raised with respect to the inclined surface 615*a*. As such, upon assembling, the shutter cylinder 60 can be inserted into the shutter installation cylinder 32 smoothly without the base end flange 611 interfering with a left edge of the shutter installation cylinder 32. As a result thereof, ease of assembly of the shutter cylinder 60 with respect to the shutter installation cylinder 32 can be improved.

The cylindrical retaining body 62 is provided with a pair of retaining claw portions 621 formed such that portions of the peripheral surface opposite to each other are cut into a U-shape, and is formed with a pair of spill holes 622 such that they are opposite to the pair of retaining claw portions 621 with a phase shift of 90 degrees.

The retaining claw portion 621 prevents a movement of the screw shaft 511 in its axial direction when the shutter cylinder 60 is inserted into the shutter installation cylinder 32 from a left surface opening, and more specifically, it prevents the screw shaft from dropping out to the left. The retaining claw portion 621 also regulates rotation around the cylinder axis beyond a predetermined range, and more specifically, it allows the shutter member 60 to rotate only between the closed position T1 and the open position T2.

The retaining claw portion 621 includes a claw main body 621*a* projecting from a right end of the cylindrical retaining body 62 to the space cut into the U-shape, and a retaining claw 621*b* projecting outward from a leading end (left end) of this claw main body 621*a*. The claw main body 621*a* projects outward from the ring-shaped seal 66. The retaining claw 621*b* includes an orthogonal plane 621*c* that is orthogonal to the cylinder axis, and an inclined surface 621*d* that inclines toward the claw main body 621*a* from the outermost side of this orthogonal plane 621*c*.

When the shutter cylinder 60 is inserted into the shutter installation cylinder 32, the inclined surface 621*d* of the retaining claw portion 621 comes into contact with the annular projection 322 after a right end of the cylindrical retaining body 62 passes the annular projection 322 of the shutter installation cylinder 32. This contact guides and elastically presses down the retaining claw portion 621 in the axial direction such that the retaining claw 621*b* can pass through the annular projection 322.

Then, the retaining claw portion 621 recovers to an original shape when the retaining claw 621*b* passes the annular projection 322. Accordingly, the orthogonal plane 621*c* of the retaining claw 621*b* comes to be opposite to the annular projection 322, such that the shutter cylinder 60 is prevented from dropping out to the left.

On the other hand, a bottom of the container main body 31 is provided with a small arc-shaped trough 316*b* (FIG. 6) between the arc-shaped projection 316*a* and the shutter installation cylinder 32, and a large arc-shaped trough 316*c* bridged between a left edge of the small arc-shaped trough 316*b* and a right edge of the shutter installation cylinder 32.

The small arc-shaped trough 316*b* is given a curvature radius of an inner surface slightly larger than a radius of an outer surface of the cylindrical retaining body 62 and thereby the cylindrical retaining body 62 slidably rotates together with the small arc-shaped trough 316*b*. Also, the large arc-shaped trough 316*c* is given a curvature radius of the inner surface that is slightly larger than a curvature radius of an inner surface of the small arc-shaped trough 316*b* and is such that interference is avoided with a leading end of the retaining claw 621*b* of the cylindrical retaining body 62 in the radial direction as shown in FIG. 14B.

The large arc-shaped trough 316*c* includes an arc-like projecting portion 316*d* which is a recessed part of the large arc-shaped trough 316*c* at a position forward from center, thereby allowing the part of the large arc-shaped trough to project inward. This arc-like projecting portion 316*d* is given a curvature radius of an interior surface smaller than a distance between a shaft center of the screw shaft 511 and a leading end of the retaining claw 621*b*. Therefore, the shutter cylinder 60 can rotate around the cylinder axis in a range between a position where either one of the pair of retaining claws 621*b* comes into contact with and thus is stopped by the arc-like projecting portion 316*d*, and a position where the remaining one of the pair of retaining claws comes into contact likewise comes into contact with and is stopped by the arc-like projecting portion 316*d*. FIG. 15 illustrates the lower retaining claw 621*b* contacting and thus being stopped by a lower edge of the arc-like projecting portion 316*d*. Accordingly, a rotatable range of the shutter cylinder 60 is limited and thereby rotation in a range other than this rotatable range is prevented.

As shown in FIG. 15, the shutter cylinder 60 is set in the open position T2 so that the lower retaining claw 621*b* comes into contact with and thus is stopped by the lower end of the arc-like projecting portion 316*d*. The shutter cylinder 60 in the above state can be rotated in a clockwise direction around the cylinder axis until the shutter cylinder 60 changes to the closed position T1 whereby the upper retaining claw 621*b* comes into contact with and is stopped by an upper end of the arc-like projecting portion 316*d*.

The spill holes 622 are adapted for allowing toner into the toner charging chamber Z when the toner within the toner charging chamber Z is fed to the shutter cylinder 60 by the driving force of the conveying member 50, for example, with the shutter cylinder 60 in the closed position T1. With this structure, the toner fed to the shutter cylinder 60 is prevented from clotting.

The circular closure 63 is provided for closing a left end surface of the shutter cylinder body 61. The circular closure 63 includes a closing disc 631 and an annular member 632. The closing disc 631 is concentric with the axis of the shutter cylinder body 61, secured to a left end of the shutter cylinder body 61, and has a diameter larger than that of the shutter cylinder body 61. The annular member 632 is integrally attached with a peripheral surface of the closing disc 631 with the annular member projecting to the left from the closing disc 631.

At a central position of a right surface of the closing disc 631, there is provided a shaft supporting hole (bearing within the shutter cylinder) 633 in a recessed manner as shown in FIG. 14A. The shaft supporting hole 633 receives a left end of the screw shaft 511 in order to support the screw shaft 511 of the toner conveyance screw 51.

In other words, when the toner conveyance screw 51 is placed in the toner conveying space Z1 within the container main body 31 and a left end of the toner conveyance screw is inserted into the shutter installation cylinder 32, a left end of the screw shaft 511 is fit into the shaft supporting hole 633. Accordingly, the toner conveyance screw 51 is mounted in the toner convey space Z1 within the container main body 31 in an integrally rotatable manner around the screw shaft 511.

The operation portion 64 is provided for rotating the shutter cylinder 60 and projects leftward from the closing disc 631 of the circular closure. The operating portion 64 includes a hollow rectangle member 641 and an operation lever 642. The operating portion 64 has a hollow rectangle shape in an end surface view and projects to the left from the annular member 632 while upper corners comes into contact with the inner peripheral surface of the annular member 632. The operation lever 642 is provided to allow the user to operate by fingers of a hand and extends in a radial direction of the annular member 632 from a lower surface of the hollow rectangle member 641.

The hollow rectangle member 641 and the operation lever 642 are provided with a not-shown holder cover having a shape suitable for holding and operating thereof (In FIG. 19 described below, it is illustrated by the operation dial 85). Rotation of the shutter cylinder 60 is actually performed through this holder cover; however, the following description is worded such that the rotation of the shutter cylinder 60 is actuated by operation of the operation lever 642.

In the present embodiment, the hollow rectangle member 641 is positioned at the uppermost position of the closing disc 631, and the operation lever 642 hangs down from the hollow rectangle member 641 when the shutter cylinder 60 is set to the closed position T1 (FIGS. 12A and 12B). The shutter cylinder 60 in the closed position T1 as recited above is changed to the open position by rotating the operation lever 642 in a counterclockwise direction by about 90 degrees (see FIGS. 13A and 13B).

The locking member 65 is provided for locking the shutter cylinder 60 in the closed position T1 or in the open position T2 in a positional relation with the covering cap 70. The locking member 65 includes a projecting portion 651 projecting from an outer peripheral surface of the annular member 632 of the circular closure 63, and an elastically deformable arc-like operation member 652 which is formed into an arc-like shape and extends from a leading end of the projecting portion 651 in a clockwise direction in FIG. 12A In the example here, the projecting portion 651 is provided at the upper rear of the annular member 632 and the arc-shaped operation member 652 is given a central angle of curvature of 90 degrees such that the shutter cylinder 60 is set to the closed position T1 (FIGS. 12A and 12B).

The arc-like operation member 652 includes a wide portion 652*a* extending from the projecting portion 651 in a clockwise direction a predetermined distance slightly shorter than half of an entire length. A narrow portion 652*b* is formed in front of this wide portion 652*a* by notching the right edge over its entire length. A leading end of the narrow portion 652*b* is provided with a retaining portion 654 arranged such that it crosses the arc-like operation member 652. The retaining portion 654 projects toward an opposite and outer side of a center of curvature of the arc-like operation member 652.

An outer surface of the arc-like operation member 652 is provided with a reinforcing rib 655 which extends throughout an entire length of the narrow portion 652*b* starting from a position slightly offset from the interface between the wide portion 652*a* and the narrow portion 652*b* in the direction of the wide portion 652*a*. The arc-like operation member 652 is structurally reinforced by this reinforcing rib 655. A locking effect of a locking member 65 and its relation to the covering cap 70 will be described later together with that of the covering cap 70.

The ring-shaped seal 66 prevents toner within the toner charging chamber Z of the container main body 31 from intruding into a space between an inner peripheral surface of the shutter installation cylinder 32 and an outer peripheral surface of the shutter cylinder body 61 when the shutter cylinder 60 is inserted into the shutter installation cylinder 32. The ring-shaped seal 66 is made of an elastomer material such as a rubber material or a soft synthetic resin material (elastic material).

The ring-shaped seal 66 is given an inner diameter slightly smaller than an outer diameter of the cylindrical retaining body 62 and an outer diameter slightly larger than an inner diameter of the shutter installation cylinder 32. The ring-shaped seal 66 is fit into a base end of the cylindrical retaining body 62 of the shutter cylinder 60 such that it comes into contact with the leading end flange 612 as shown in FIGS. 14A and 14B.

The ring-shaped seal 66 is held between the leading end flange 612 of the shutter cylinder 60 and the annular projection 322 of the shutter installation cylinder 32 with the ring-shaped seal kept compressed and elastically deformed when the shutter cylinder 60 is inserted into the shutter installation cylinder 32. Accordingly, the toner within the toner charging chamber Z of the container 30 is prevented from intruding into a space between an outer peripheral surface of the shutter cylinder body 61 and an inner peripheral surface of the shutter installation cylinder 32.

Figure 16:
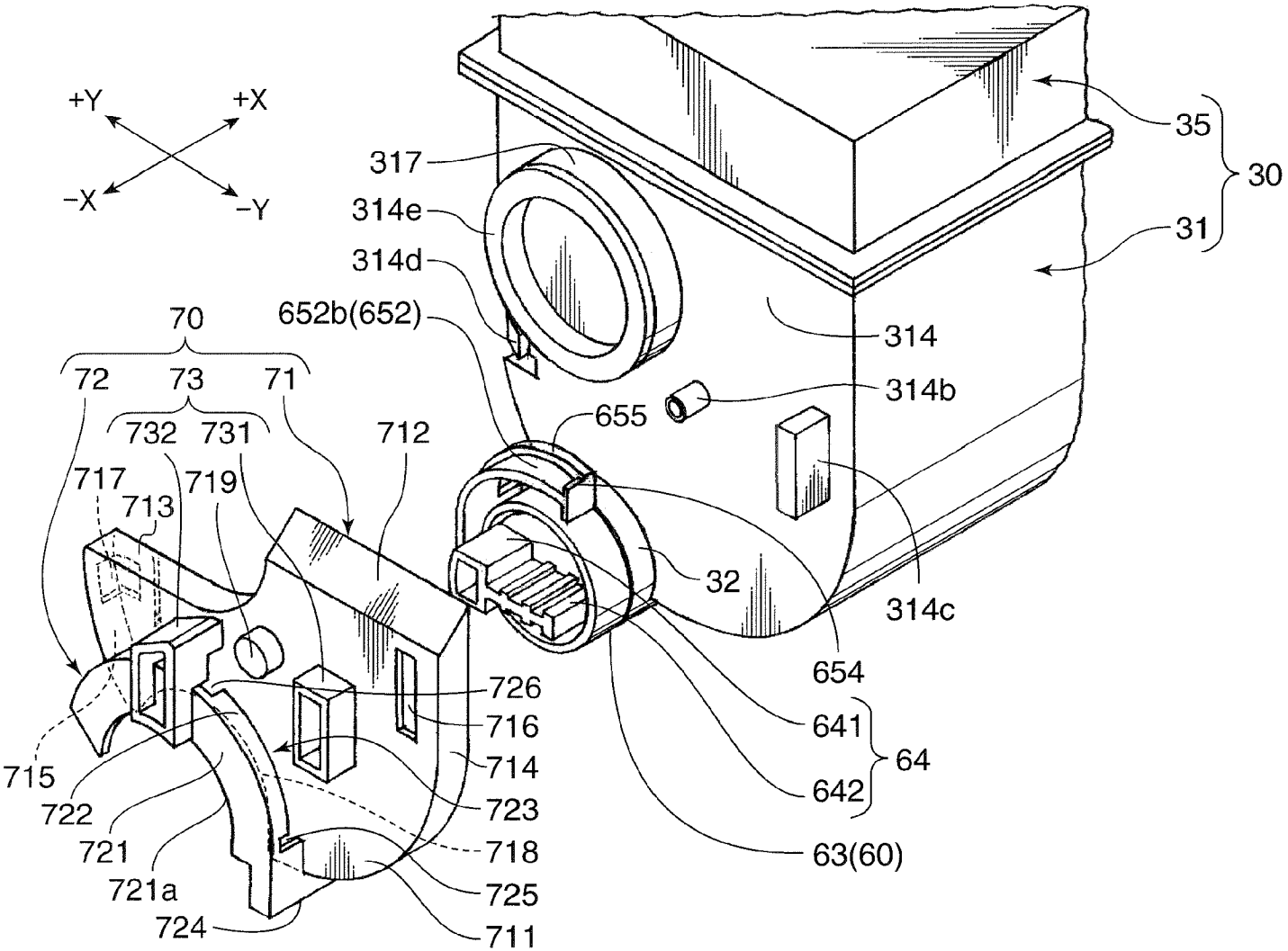
FIG. 16 is a perspective view illustrating a covering cap immediately before being mounted onto a left portion.
Figure 17:
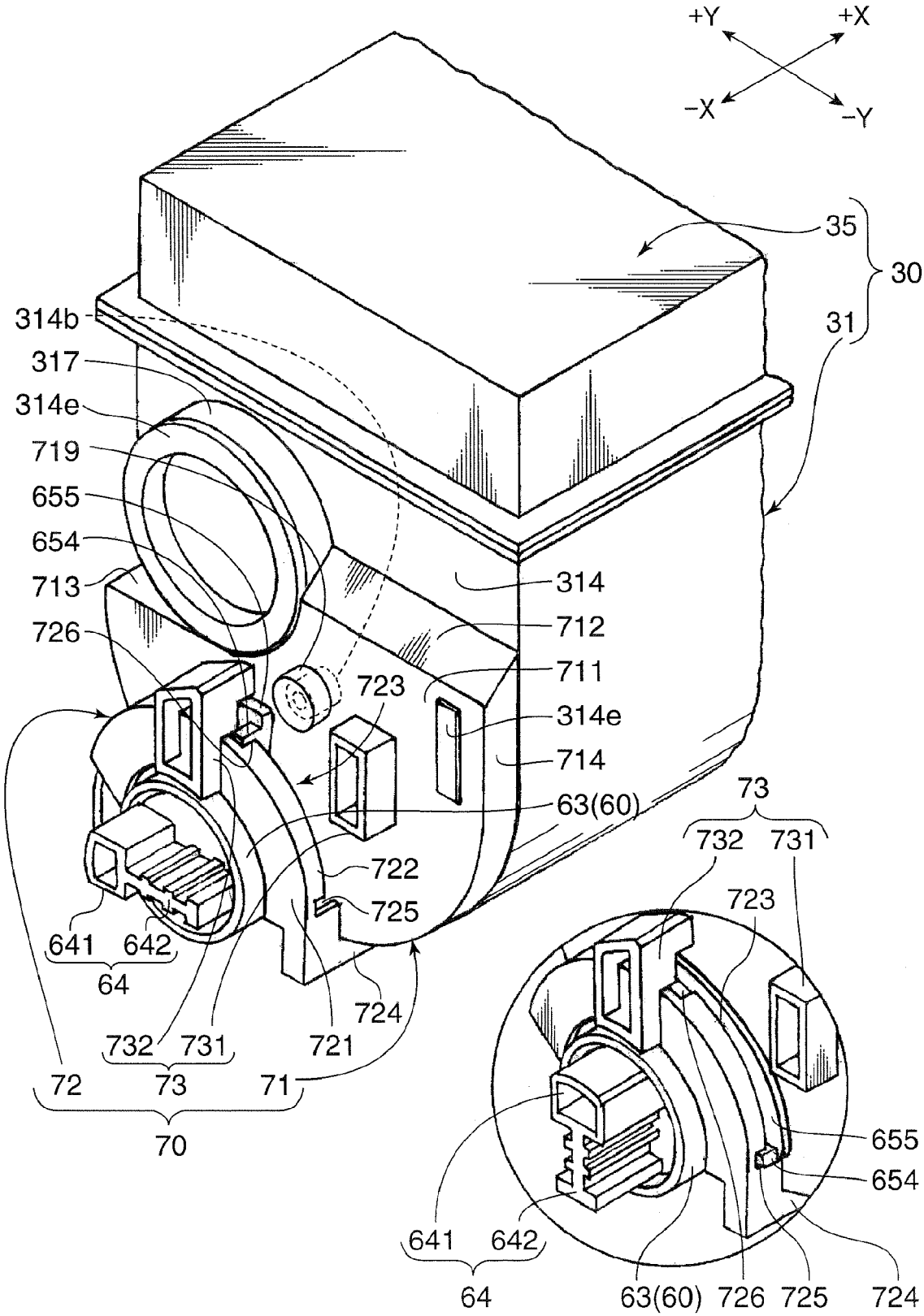
FIG. 17 is a perspective view illustrating the covering cap mounted onto the left portion, in which the shutter cylinder is in the open position. The shutter cylinder is illustrated in the closed position in the circle.

The covering cap 70 illustrated in FIG. 4 is mounted to the left portion 314 of the container main body 31 after the shutter cylinder 60 having the above described configuration is inserted into the shutter installation cylinder 32. FIGS. 16 and 17 are perspective views illustrating the covering cap 70 as one example. FIG. 16 illustrates a state immediately before the covering cap 70 is mounted to the left portion 314; and FIG. 17 illustrates the covering cap 70 mounted to the left portion 314 and the shutter cylinder 60 set to the open position T2 respectively. The circle in FIG. 17 illustrates the shutter cylinder set to the closed position T1. Indication of directions by X and Y in FIGS. 16 and 17 are identical to those in FIGS. 1A and 1B, namely, X represents a widthwise direction (−X: leftward, +X: rightward) and Y represents a forward and backward direction (−Y: forward, +Y: backward). In the meantime, description and illustration are omitted in the drawings and the following description as to a retaining projection 733 (retaining portion) of the covering cap 70 which is the feature of the present embodiment. The retaining projection 733 will be described later with reference to FIGS. 19A trough 20D.

As shown in FIG. 16, the covering cap 70 includes: a cover main body 71 having a shape extending along a lower half of the left portion 314 of the container main body 31; a cylinder cover 72 projecting to the left in a lower position slightly to the rear of the center of the cover main body 71 in the forward axial direction; and a projecting portion 73 projecting to the left from a front of the cover main body 71. The projecting portion 73 includes a swing prevention projection (swing prevention portion) 731 provided at a front position of a half-moon shaped member 711, which will be described below, and a central projection 732 formed on the cylinder cover 72 at a substantially central position of the half-moon shaped member 711.

The forward swing prevention projection 731 is a linear projection extending in the mounting direction of the toner container 20 onto the container accommodation chamber Q. The forward swing prevention projection 731 engages with a not-shown retaining member provided on a side wall opposing the forward swing prevention projection 731 of the apparatus main body 11 when the container 30 is mounted to the partition 18 of the container accommodation chamber Q of the apparatus main body 11. Accordingly, the toner container 20 is prevented from swinging by the driving force of the toner conveyance screw 51.

The cover main body 71 includes: the half-moon shaped member 711 in which its lower portion forms a half-moon shape so as to conform to a shape of a lower portion of the left portion 314 of the container main body 31 excluding a certain portion where the cylinder cover 72 is provided; an upward inclining edge portion 712 extending obliquely upward from a leading edge of the substantially front half portion of the half-moon shaped member 711; an upper curved edge portion 713 extending from a leading edge of the about the substantially rear half portion of the half-moon shaped member 711; a front arc-shaped edge portion 714 extending to the right from an arc-shaped edge portion located forward of the half-moon shaped member 711; and a rear arc-shaped edge portion 715 extending to the right from an arc-shaped edge portion located to the rear of the half-moon shaped member 711.

A leading portion of a rear portion of the half-moon shaped member 711 is provided with a notch along an outer periphery of the toner charging cylinder 317 in order to avoid interference with the toner charging cylinder 317 which encloses the toner charging hole 314*a* of the container main body 31. The upward curved edge portion 713 is formed into an arc-shape so as to conform with this notch.

An upper front of the half-moon shaped member 711 is formed with a retaining hole 716. The retaining hole 716 receives the retaining projection 314*c* provided on the left portion 314 of the container main body 31, and thus is positioned corresponding to the retaining projection 314*c*. Also, a corner where the rear of the half-moon shaped member 711 mates with the rear arc-shaped edge portion 715 has a square hole 717 for receiving the retaining claw portion 314*d* provided on the left portion 314.

At a lower and slightly backward position of the half-moon shaped member 711, there is provided an arc-shaped concave portion 718 for mating the half-moon shaped member 711 with the shutter installation cylinder 32 from above. Additionally, a sheath cylinder 719 for receiving the shaft supporting cylinder 314*b* (FIG. 4) projecting to the left from the left portion 314 is formed at substantially the center of the half-moon shaped member 711.

This sheath cylinder 719 is open at an interior side (right side) but is closed at a left side (left side), resulting in forming a so-called dead-end cylinder. The shaft supporting cylinder 314*b* has a through-hole into which the shaft member 41 of the agitator 40 is inserted, whereas the sheath cylinder 719 serves as a cap for sealing this through-hole. An inner diameter of the sheath cylinder 719 is such that it can be slidably fit onto the shaft supporting cylinder 314*b*. When the covering cap 70 is mounted onto the left portion 314 of the container main body 31, the sheath cylinder 719 is fit onto the shaft supporting cylinder 314*b* in a sealing manner as shown in FIG. 17. Accordingly, the toner within the container main body 31 is prevented from leaking to the outside through the through-hole of the shaft supporting cylinder 314*b*.

Thus, the retaining claw portion 314*d* is mounted into the square hole 717 and secured thereto when the retaining hole 716 is fit to the left portion 314, whereby the covering cap 70 is latched on the container main body 31.

The cylinder cover 72 is provided for covering the shutter cylinder 60 after the covering cap 70 is mounted to the container main body 31. Such a cylinder cover 72 includes a crescent portion 721 of a crescent shape, and a periphery portion 722 formed so as to conform to an outer peripheral edge of curvature of the arc-like crescent portion 721. The periphery portion 722 is secured at its base edge to an edge of the arc-shaped concave portion 718 of the half-moon shaped member 711.

In the arc-like crescent portion 721, a center of curvature is concentric with an axis of the circular closure 63 of the shutter cylinder 60, and there is included an inner arc-like edge 721*a* having a curvature radius slightly larger than an outer diameter of the circular closure 63. Therefore, since the covering cap 70 is mounted to the left portion 314 of the container main body 31 while the shutter cylinder 60 is inserted into the shutter installation cylinder 32, an outer peripheral surface of the circular closure 63 will be opposed to an inner peripheral edge of the inner arc-like edge 721*a*.

The periphery portion 722 is provided such that its interior surface comes into sliding contact with the arc-like operation member 652 of the shutter cylinder 60. There is formed a guide groove 723 between the periphery portion 722 and the arc-shaped bottom portion 311 of the container main body 31. The guide groove 723 receives the reinforcing rib 655 provided on the arc-like operation member 652 of the shutter cylinder 60. The reinforcing rib 655 is given a thickness in a radial direction such that an outer peripheral surface of the reinforcing rib 655 projects slightly outward from the guide groove 723 when engaged with the guide groove 723.

An end of the guide groove 723 in a clockwise direction in FIG. 16 is provided with a securing portion 724 for securing the cylinder cover 72 to the cover main body 71. In the shutter cylinder 60, a leading end of the reinforcing rib 655 interferes with the securing portion 724, thereby restricting further rotation of the shutter cylinder in a clockwise direction.

A position corresponding to an end of the guide groove 723 in a clockwise direction in the periphery portion 722 is provided with a first retaining groove 725 which is notched to the left in a recessed manner. Also, a position adjacent to the front of a center projection 732 in the guide groove 723 is provided with a second retaining groove 726 which is formed such that the periphery portion 722 is notched to the left. The first retaining groove 725 is provided for engaging with a retaining portion 654 of the arc-like operation member 652 when the shutter cylinder 60 is in the closed position T1. The second retaining groove 726 is provided for engaging with the retaining portion 654 when the shutter cylinder 60 is in the open position T2.

Therefore, when the covering cap 70 is attached to the container main body 31 to which the shutter cylinder 60 is mounted, the shutter cylinder 60 rotates in a forward and backward direction around the cylinder axis such that the reinforcing rib 655 slides in the guide groove 723 by an operation of the operation lever 642, and such that the retaining portion 654 of the lock member 65 provided on the shutter cylinder 60 engages with the guide groove 723. Thus, the shutter cylinder 60 can change its position between the closed position T1 and the open position T2.

When the shutter cylinder 60 is set to the closed position T1, the retaining portion 654 engages with the first retaining groove 725, thereby locking the shutter cylinder 60 at its closed position T1. Also, when the shutter cylinder 60 is set to the open position T2, the retaining portion 654 engages with the second retaining groove 726, thereby locking the shutter cylinder 60 at its open position T2.

Upon changing a position of the shutter cylinder 60, the user need only press the arc-like operation member 652 extending outward from the guide groove 723 in a direction of the guide groove 723. Then, the arc-like operation member 652 elastically deforms and thus the retaining portion 654 is released from the first retaining groove 725 or the second retaining groove 726, such that the shutter cylinder 60 becomes rotatable. At this time, if the operation lever 642 is operated, the position of the shutter cylinder 60 can be changed.

Figure 18A:
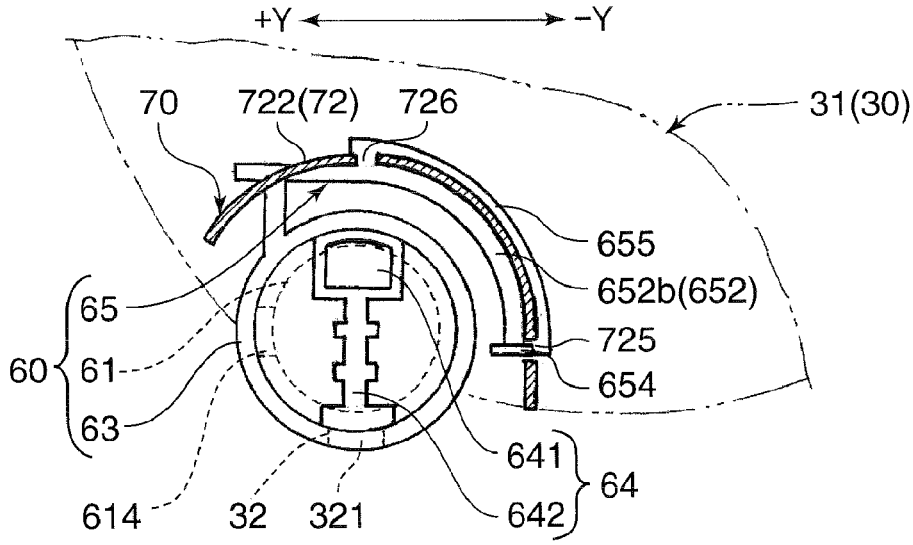
FIGS. 18A, 18B, and 18C are partial cross sectional views each illustrating the toner container viewed from the left to illustrate an operation of a locking mechanism of the shutter cylinder.
Figure 18B:
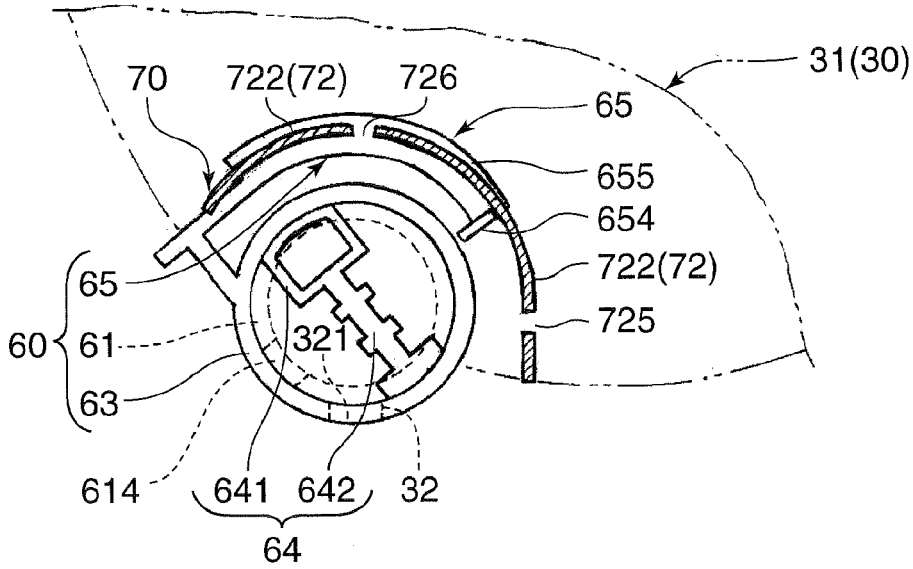
Figure 18C:
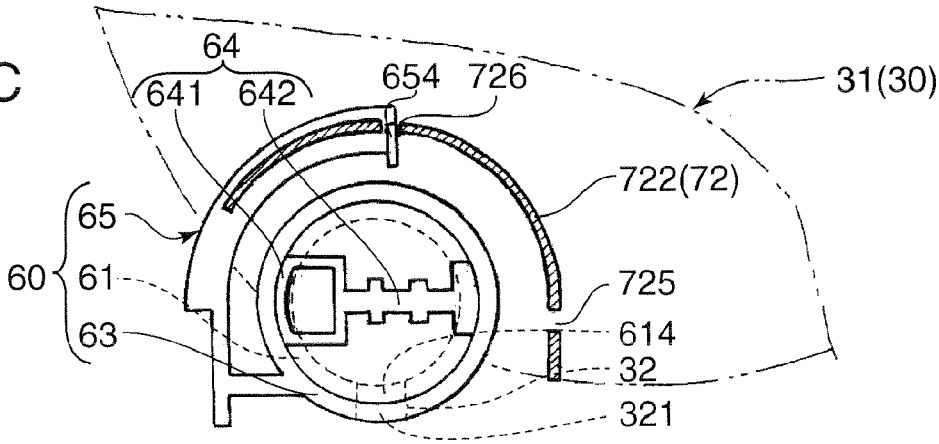

FIGS. 18A to 18C are partial cross sectional views of the toner container 20 in left side view, each illustrating an effect of a locking mechanism of the shutter cylinder 60. FIG. 18A illustrates the shutter cylinder 60 in the closed position T1. FIG. 18B illustrates the shutter cylinder 60 about to change its position from the closed position T1 to the open position T2. FIG. 18C illustrates the shutter cylinder 60 changed to the open position T2. The forward and backward direction indicated by Y in FIGS. 18A to 18C is identical to that in FIGS. 1A and 1B (−Y: forward, +Y: backward).

As shown in FIG. 18A, when the shutter cylinder 60 is set to the closed position T1 corresponding to the configuration before the toner container 20 is installed in the printer 10, the toner discharge opening 614 of the shutter cylinder body 61 of the shutter cylinder 60 is oriented to the rear. Therefore, the toner within the container main body 31 will not be released through the toner discharge hole 321 of the shutter installation cylinder 32.

Also, in the above condition, the retaining portion 654 at a leading end of the locking member 65 provided on the shutter cylinder 60 fits into the first retaining groove 725 provided on the periphery portion 722 of the covering cap 70 to be retained therein. Thus, the shutter cylinder 60 is locked such that the closed position T1 of the shutter cylinder 60 becomes stable.

When the toner container 20 is mounted to the printer 10, the user operates the operation lever 642 in order to replenish the container 30 of the developing device 122 with toner. However, prior to this operation, the user presses the reinforcing rib 655 projecting outward from the guide groove 723 of the covering cap 70 in the axial direction of the shutter cylinder 60 as illustrated in FIG. 9. Accordingly, the arc-like operation member 652 is elastically deformed, resulting in the release of the retaining portion 654 from its locked configuration in the first retaining groove 725. As such the shutter cylinder 60 becomes rotatable around the cylinder axis.

The operation lever 642 is operated in a counterclockwise direction around the cylinder axis in this state, and the shutter cylinder 60 thereby rotates in a counterclockwise direction in such a manner that the retaining portion 654 comes into sliding contact with an internal surface of the periphery portion 722 as shown in FIG. 18B.

When the shutter cylinder 60 rotates by about 90 degrees, the toner discharge opening 614 of the shutter cylinder 60 is changed to the open position T2 which corresponds to the toner discharge hole 321 of the shutter installation cylinder 32 as shown in FIG. 18C. Then, the inside of the toner charging chamber Z of the toner container 20 connects to the developing device 122 through the toner discharge opening 614 of the shutter cylinder 60 and the toner discharge portion 321 of the toner container 20. As such, the toner within the toner container 20 can be charged to the developing device 122.

When the shutter cylinder 60 is changed to the open position T2, the arc-like operation member 652 that is elastically deformed then recovers to the original shape and thus the retaining portion 654 of the shutter cylinder 60 fits into the second retaining groove 726 of the periphery portion 722. As such, the shutter cylinder 60 is locked to the open position T2.

When toner is consumed and thus the toner container 20 becomes empty, the toner container 20 is changed to a new toner container 20, and the shutter cylinder 60 which is set to the open position T2 is changed to the closed position T1 by means of the operation lever 642.

The reinforcing rib 655 is initially pressed to release the retaining portion 654 that is engaged with and retained by the second retaining groove 726 for unlocking. The operation lever 642 is continuously operated in the clockwise direction. This operation rotates the shutter cylinder 60 in the clockwise direction while the retaining portion 654 comes into sliding contact with an interior surface of the periphery portion 722. When the shutter cylinder rotates by about 90 degrees, the shutter cylinder 60 changes its position to the closed position T1 and the retaining portion 654 fits into the first retaining groove 725, thereby locking the shutter cylinder 60 in the closed position.

Upon exchange of the toner container 20, even if an old toner container is removed from the printer 10 and handled for toner recovery, the leakage of toner from the toner container 20 is reliably prevented.

Figure 19B:
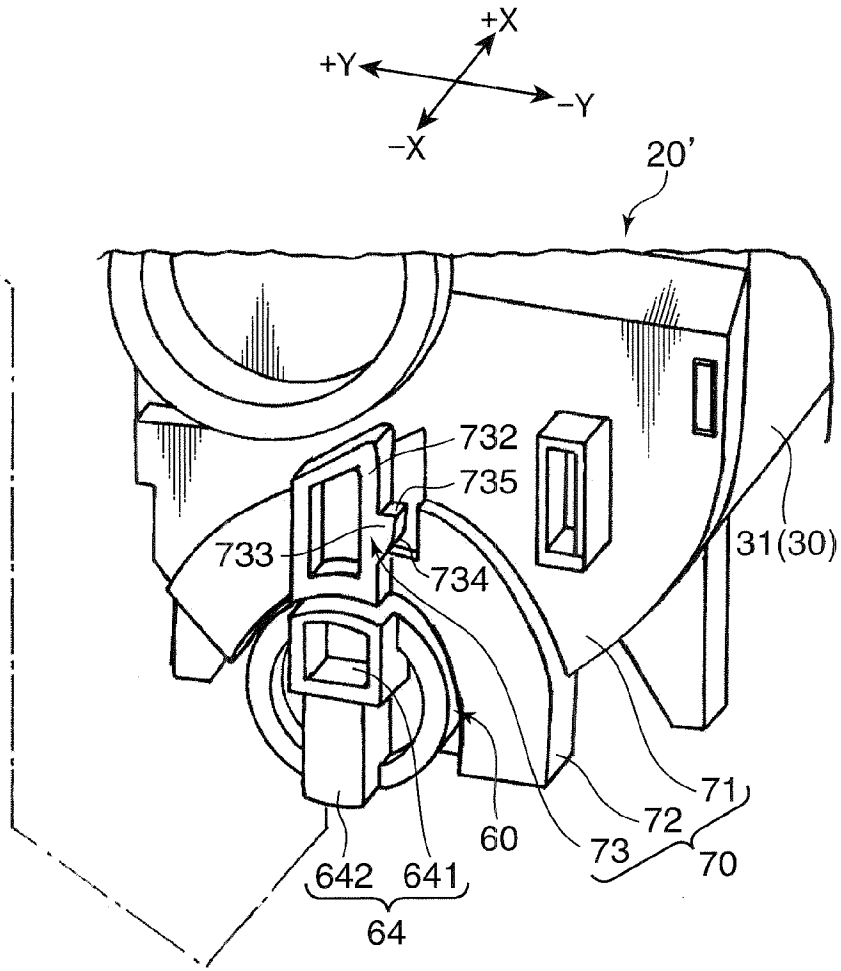
FIGS. 19A and 19B are perspective views illustrating a main part of the toner container.
Figure 19A:
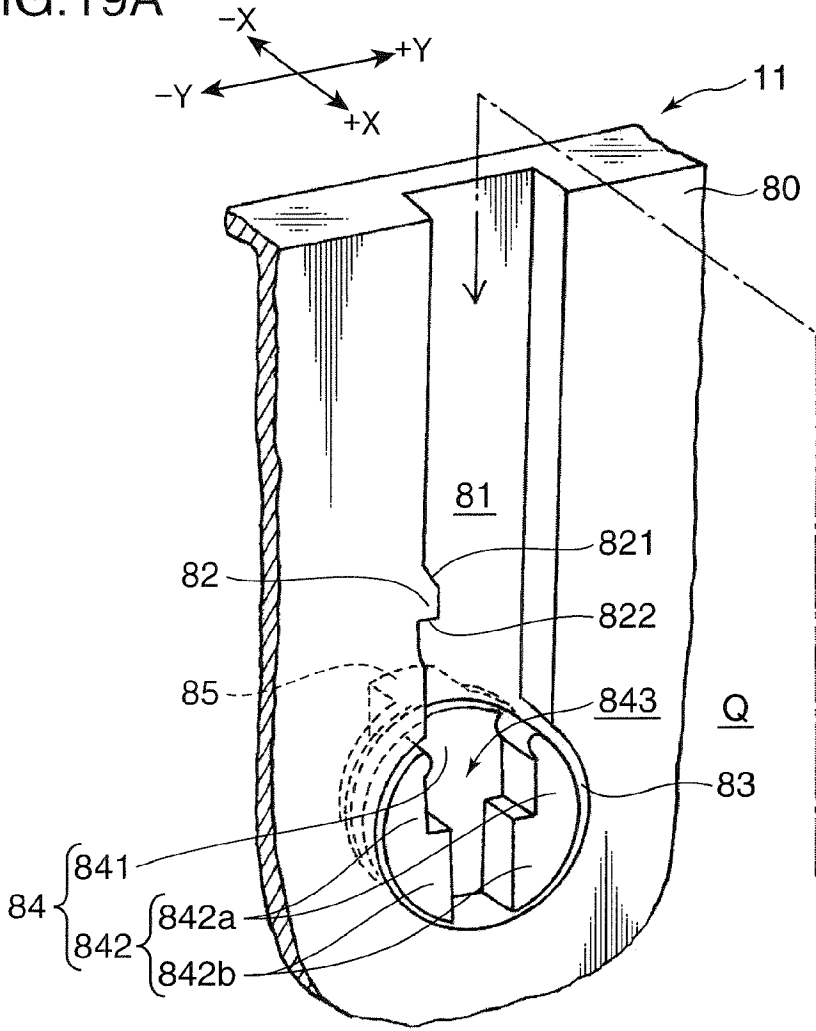

Now, an engagement configuration between the toner container and a printing apparatus main body as one of the features of the present embodiment will be described. Here, a toner container 20' comprising a covering cap 70 with a retaining projection 733 (retaining portion) is illustrated. FIGS. 19A and 19B are perspective views illustrating the toner container 20'. FIG. 19A is a partial perspective view of a partition wall 80 to which a left end of the toner container 20' is to be installed and FIG. 19B illustrates a partial perspective view illustrating a left end of the toner container 20'. Directions indicated by X and Y in FIGS. 19A and 19B are identical to those in FIG. 1, namely, X indicates a widthwise direction (−X: leftward, +X: rightward) and Y indicates a forward and backward direction (−Y: forward, +Y: backward). The toner container 20' is partially different in shape from the toner container 20 in FIGS. 16 and 17; however, components of the toner container 20' given the same reference numbers as the toner container 20 will perform the same function as those of the toner container 20.

As shown in FIG. 19A, the operation side (left side in FIG. 2B) of the container accommodation chamber Q of the apparatus main body 11 is provided with a partition wall 80 at a position where a recessed support portion 102 is to be provided. The partition wall 80 is provided at a right side thereof (a side oriented to the container accommodation chamber Q) with a guide groove 81 extending in a vertical direction so as to correspond to the recessed support portion 102.

The guide groove 81 serves to guide the central projection 732 of the container 30 shown in FIG. 19B. When the container 30 is installed into the container accommodation chamber Q, the central projection 732 of the toner container 20' is engaged with and thus pushed down along the guide groove 81. A guidance of the central projection 732 by the guide groove 81 will ease the installation of the container 30 into the container accommodation chamber Q.

The guide groove 81 is formed with a groove side retaining projection 82 (second retaining portion) on one of the groove walls (FIG. 19 exemplifies an appropriate position of a front groove wall). A top of the groove side retaining projection 82 is provided with an inclined surface 821 inclining downward to the center of the guide groove 81 in the forward and backward direction and a bottom of the groove side retaining projection 82 is provided with a horizontal surface 822 in a horizontal position.

On the other hand, the central projection 732 of the covering cap 70 installed into the left end surface of the container main body 31 is provided with a container side retaining projection 733 to be formed with the groove side retaining projection 82 at a position corresponding to the groove side retaining projection 82, as shown in FIG. 19B in which its front end surface is shown. The container side retaining projection 733 is formed of an elastically deformable material. Also, the central projection 732 including the container side retaining projection 733 is caved at a center of the left surface of the central projection, i.e., is reduced of its thickness, thereby allowing the container side retaining projection to be elastically deformed with ease.

The bottom of the container side retaining projection 733 is formed with an inclined surface 734 corresponding to the inclined surface 821 of the groove side retaining projection 82 and the top of the container side retaining projection 733 is formed with a horizontal surface 735 on a side of the movement prevention projection 73 corresponding to a horizontal surface portion 822 of the groove side retaining projection 82.

Since the central projection 732 is engaged with the guide groove 81, the container side retaining projection 733 is engaged with the groove side retaining projection 82 after it passes through the groove side retaining projection 82. Because of this engagement configuration, the container 30 is prevented from dropping off.

A bottom of the guide groove 81 is formed with a circular recess 83. The circular recess 83 receives an operation disc 84 for operating the operating portion 64. The operation disc 84 includes a disc main body 841 coming into sliding contact with the bottom of the circular recess 83, and a symmetrically paired pinching portions 842 for pinching the operating portion 64, the pinching portions projecting from a right surface of the disc main body 841 toward the container accommodation chamber Q.

Each of the pinching portions 842 includes a thin portion 842*a* where a distance between the paired pinching portions is slightly larger than a length of the rectangular member 641 of the operating portion in the forward and backward direction, and a thick portion 842*b* where a distance between the paired pinching portions is slightly larger than a length of the operation lever 642 of the operating portion 64 in the forward and backward direction. There is formed an operation groove 843 between the paired pinching portions 842 in which the paired thin portions 842*a* can receive the rectangular member 641 and the pair of operation lever 642.

The operation disc 84 is coupled with the operation dial 85 provided on the left surface of the partition wall 80 through a not-shown coupling shaft which eccentrically passes through a bottom of the circular recess 83 in an integrally rotatable manner. Therefore, the operating portion 64 is placed to be engaged with the operating groove 843 when the container 30 is housed in the container accommodation chamber Q. If the user rotates the operation dial 85 in the above stated manner, the operation lever 642 is actuated and thereby the shutter cylinder 60 is opened and closed.

Since the left surface of the container 30 is covered by the partition wall 80, the user cannot manually operate the locking member 65 (FIG. 12) of the shutter cylinder 60. Consequently, the locking member 65 is automatically unlocked because of the interference with a predetermined member on a side of the apparatus main body 11 while the container 30 is installed in the container accommodation chamber Q, whereas the interference is released when the container 30 is removed from the container accommodation chamber Q to automatically place the locking member in a locked condition.

Figures 20A, 20B, 20C, 20D:
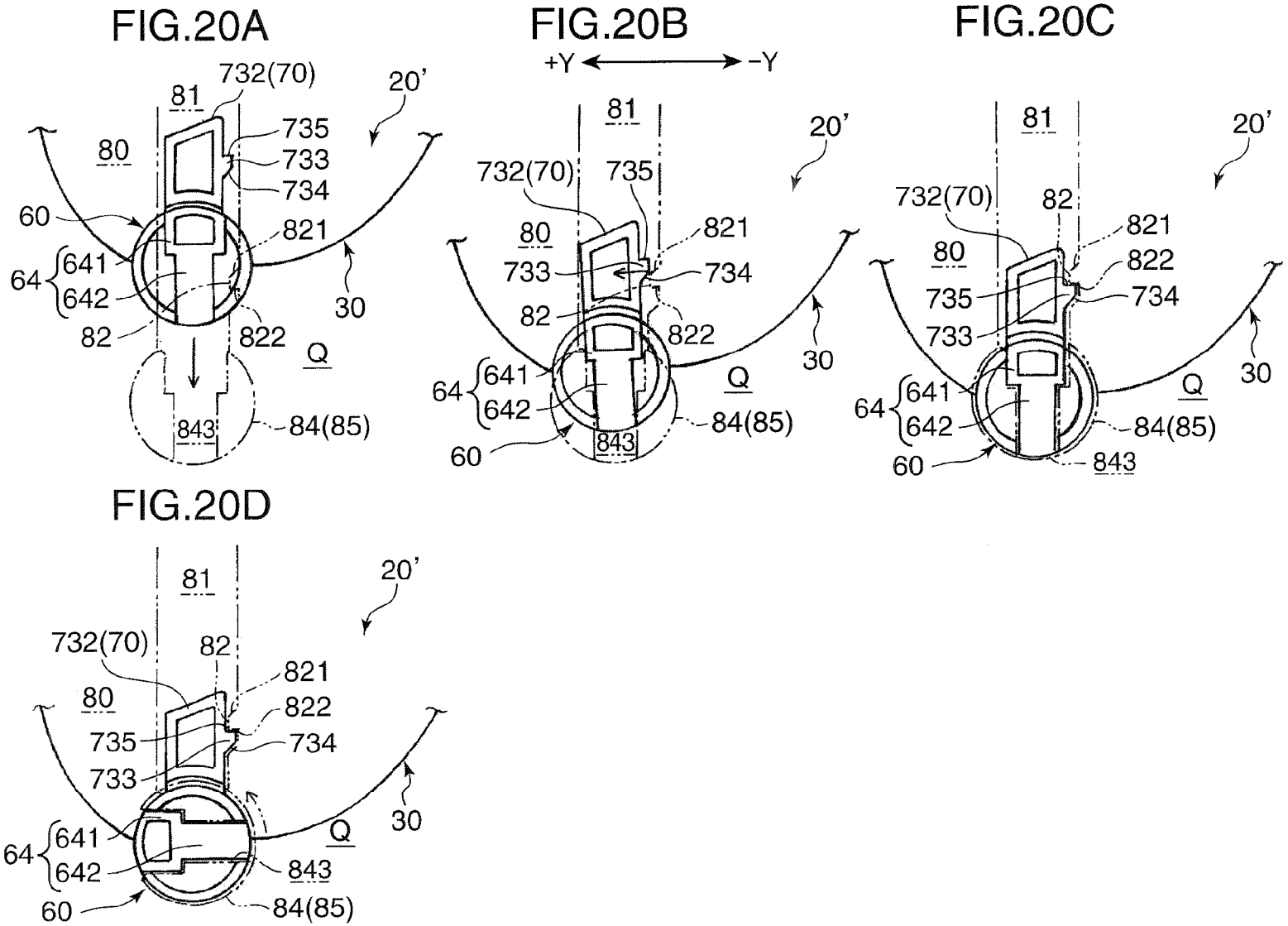
FIGS. 20A through 20D are explanatory diagrams illustrating actions of each of a retaining projection on the container and a retaining projection at a partition wall and an operation disc at the partition wall.

FIGS. 20A through 20D are explanatory diagrams illustrating actions of the retaining projections 82, 733 and the operation discs 84. FIG. 20A illustrates the container 30 to be inserted into the container accommodation chamber Q; FIG. 20B illustrates the container side retaining projection 733 elastically deformed; FIG. 20C illustrates a state that the container 30 is installed into the container accommodation chamber Q and therefore the operating portion 64 of the shutter cylinder 60 is engaged with the operation groove 843 of the operating disc 84; and FIG. 20D illustrates a state that the operation lever 642 is actuated through the operation dial 85 to open the shutter cylinder 60. A direction indicated by Y in FIGS. 20A through 20D is identical to that in FIG. 19 (−Y: forward, +Y: backward).

When the container 30 is installed into the container accommodation chamber Q, as shown in FIG. 20A, the central projection 732 of the container 30 is engaged with the guide groove 81 of the partition wall 80, and the container 30 in this state descends. Even if the container side retaining projection 733 interferes with the groove side retaining projection 82 while the container descends, the inclined surface 734 of the container side retaining projection 733 comes into sliding contact with the inclined surface 821 of the groove side retaining projection 82 to cause an elastic deformation of the central projection 732, thereby allowing the container 30 to consistently descend, as shown in FIG. 20B.

When the container 30 is finally installed into the container accommodation chamber Q, the operating portion 64 of the shutter cylinder 60 of the container 30 comes to be engaged with the operation groove 843 of the operating disc 84 provided on the partition wall 80 of the apparatus main body 11 as shown in FIG. 20C. Under the above circumstances, as shown in FIG. 20D, the operation dial 85 is rotated in the counterclockwise direction to actuate the operation lever 642 through the operating disc 84, thereby allowing the shutter cylinder 60 to change its position from the closed position T1 (FIG. 14A) to the open position T2 (FIG. 14B). As such, the toner within the container 30 can be supplied to the developing device 122.

When the container 30 is lifted up from the container accommodation chamber Q, the operation dial 85 is operated in the clockwise direction from a state illustrated in FIG. 20D to allow the shutter cylinder 60 to change its position from the open position T2 to the closed position T1. If the container 30 is lifted up in this state, the horizontal surface 735 of the container side retaining projection 733 interferes with the horizontal surface 822 of the groove side retaining projection 82.

However, the concave handle 38 provided on the container 30 is positioned, as shown in FIG. 10, in such a manner that the handle is shifted to a right end side opposite to a side (left end side) where the movement prevention projection 73 is provided. Therefore, if the user holds the concave handle 38 to lift it up, the container 30 pivots at an upper left corner (more specifically, a portion where the upper end edge of the left surface of the container main body 31 comes into contact with the partition wall 80) as a supporting point to be brought into an inclined condition in the widthwise direction.

Under the circumstances, a length of the bottom surface of the container 30 viewed in plane becomes shorter than a length of the container accommodation chamber Q in the widthwise direction (a length in X-X direction), and therefore the lower left end of the container 30 comes to depart from the partition wall 80. Accordingly, the operating portion 64 of the container 30 is disengaged from the operation groove 843 of the operation disc 84 at the side of the partition wall 80 as well as the container side retaining projection 733 is also disengaged from the groove side retaining projection 82. As a result thereof, the toner container 20' can be lifted up from the container accommodation chamber Q.

According to the above described toner container 20', since the container side retaining projection 733 and the groove side retaining projection 82 are engaged to each other, the container 30 once installed into the apparatus main body 11 can be prevented from being accidentally removed from the apparatus main body while the shutter cylinder 60 is in the open position.

Upon removal of the container 30 from the apparatus main body 11, the container 30 needs to be inclined. This inclining operation can be stably achieved by holding the concave handle 38 and thus the working property in removing the container 30 from the apparatus main body 11 can be improved.

Second Embodiment

Figure 21A:
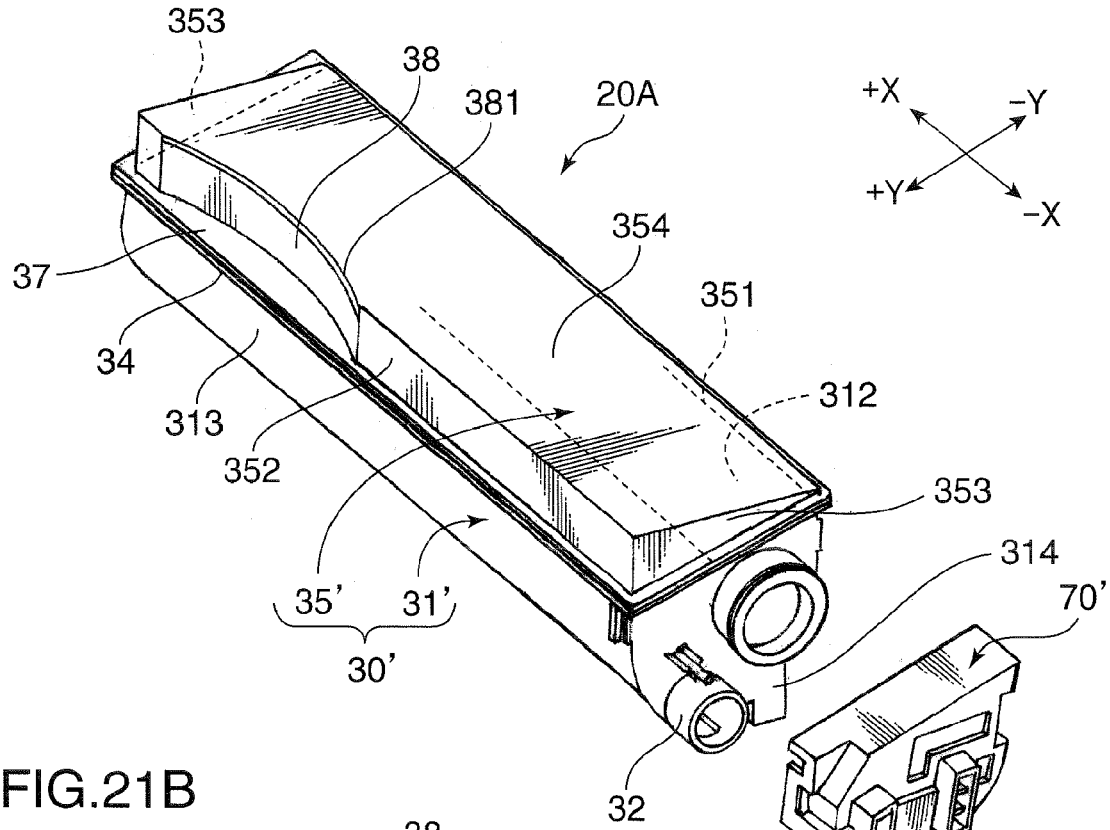
FIGS. 21A and 21B are perspective views illustrating a toner container according to a second embodiment.
Figure 21B:
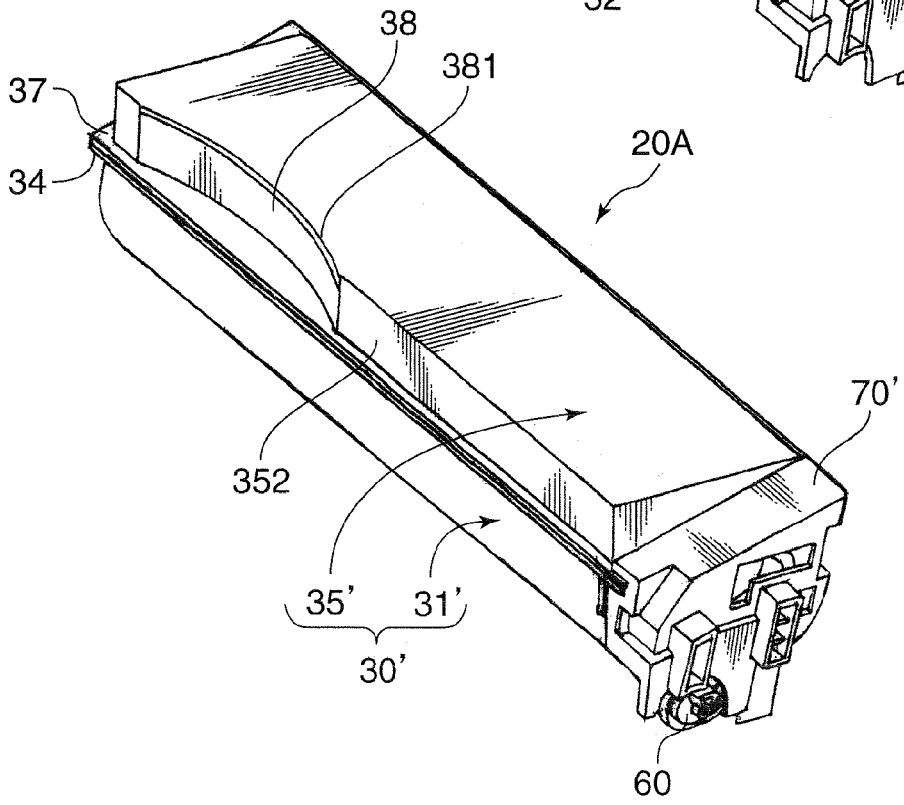

Now, a toner container 20A according to a second embodiment will be described. FIGS. 21A and 21B are perspective views illustrating a toner container 20A. FIG. 21A illustrates a container 30' with a covering cap 70' removed; and FIG. 21B illustrates the container 30' with the covering cap 70' installed therein, respectively. Directions indicated by X and Y in FIGS. 21A and 21B are identical to those indicated in FIG. 5 (X represents the widthwise direction (−X: leftward, +X: rightward) and Y represents the forward and backward direction (−Y: forward, +Y: backward)).

As shown in FIG. 21A, the present embodiment differs from the former embodiment in that the toner container 20A is given a vertical dimension of the rear side portion 313 of a container main body 31' shorter than a vertical dimension of the front side portion 312 of the container main body 31', whereby a top surface of the container main body 31' inclines downward in a backward direction in a side view (viewed from the −X direction).

A cover 35' is given a notably short vertical dimension of the front side portion 351 in parallel with a longitudinal direction of the toner container 20A (end opposing to the side surface), whereas a vertical dimension of the rear side portion (side surface) 352 almost conforms to that according to the former embodiment. A height of the rear side portion 352 almost conforms to a difference between the height of the rear side portion 313 and the height of the front side portion 312. Therefore, respective bottoms of the right and left side portions 353 of the cover 35' come to have oblique lines and the top portion 354 comes to be oriented in a general horizontal direction upon installation of the toner container 20A to finally form a right triangular shape.

When the cover 35' is installed into the container main body 31' to assemble the container 30', the top portion 354 of the cover 35' becomes horizontally and a flange 34 of the main body and a flange 37 of the cover 35 are inclined downward in the backward direction in side view (viewed from −X direction) as shown in FIGS. 21A and 21B. Then, the shutter cylinder 60 and the like are installed into the shutter installation cylinder 32 of the container 30' and the covering cap 70' is installed to the left portion 314, thereby the toner container 20A is completely assembled.

In the above toner container 20A, the concave handle 38 is formed only on the rear side portion 352 in parallel with the longitudinal direction of the cover 35' but is not formed on the front side portion 351 which has a shorter vertical dimension.

Although other components of the toner container 20A differs from those of the foregoing embodiment in the detailed configuration, the essential configuration of the toner container 20A is identical to that of the toner container 20 according to the foregoing embodiment.

Figure 22:
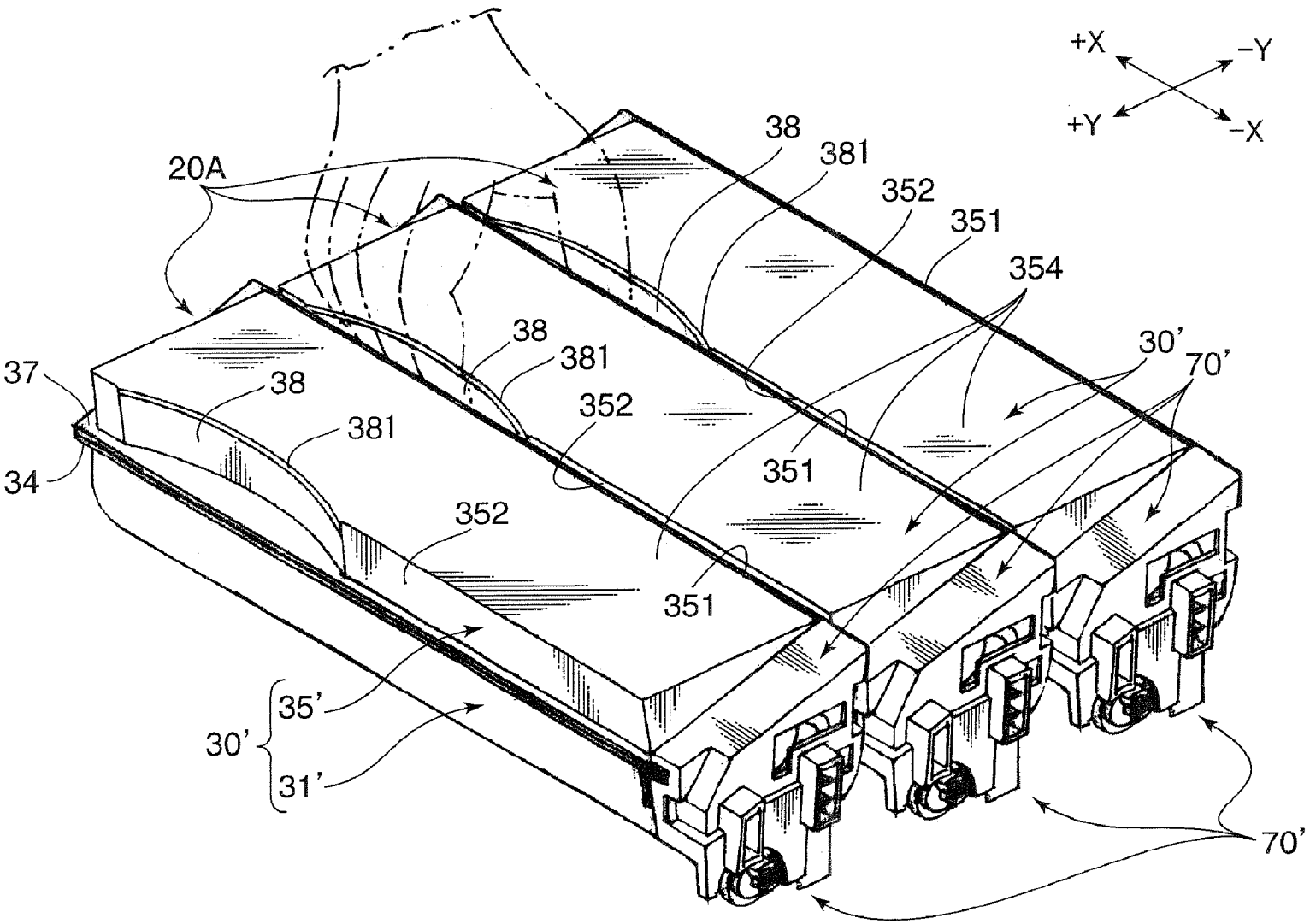
FIG. 22 is a perspective view illustrating a state that a plurality of toner containers are arranged side by side along horizontal reference lines for respective top portions of the covers.
Figure 23:
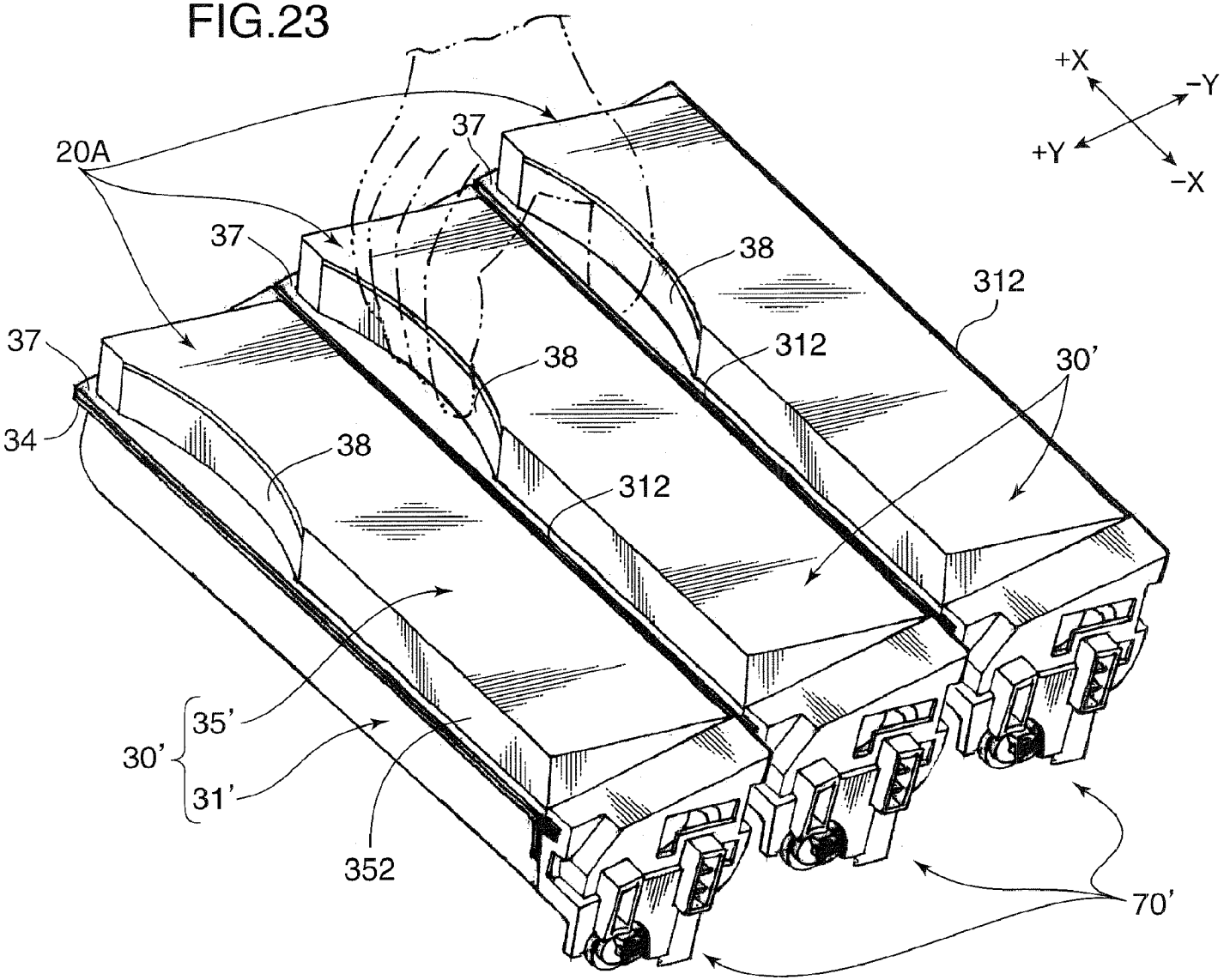
FIG. 23 is a perspective view illustrating a state that the plurality of toner containers are arranged side by side along horizontal reference lines for respective flanges of the containers.

FIGS. 22 and 23 are perspective views illustrating the toner container 20A placed side by side according to the second embodiment. FIG. 22 illustrates a plurality of toner containers 20A arranged side by side in alignment with horizontal reference lines of the covers 35'; and FIG. 23 illustrates the plurality of toner containers 20A arranged side by side in alignment with horizontal reference lines of the flanges of the containers 30', respectively. Directions indicated by X and Y in FIGS. 22 and 23 are identical to those in FIG. 5, namely, X represents the widthwise direction (−X: leftward, +X: rightward) and Y represents the forward and backward direction (−Y: forward, +Y: backward).

As shown in FIG. 22, when the plurality of toner containers 20A are arranged side by side so as to allow each top portion 354 of the respective covers 35' to align horizontally in flush (when in alignment with the horizontal reference lines), no concave handle is provided on the front side portion 351 of each cover 35' but the concave handle 38 of the cover 35' of the next toner container 20A opposing to the front side portion 351 produces a space therebetween. Therefore, as shown in FIG. 22 by an alternate long and two short dashes line, the cover 35' can be readily held by inserting fingers in this space. Accordingly, the toner container 20A can be attached to or detached from the container accommodation chamber Q of the printer 10 (FIG. 2) with ease.

Then, when the plurality of toner containers 20A are arranged side by side so as to place each of the flanges 34, 37 of the container 30 horizontally in flush as shown in FIG. 23, each concave handle 38 of the respective covers 35' is projected upward from respective backward portions of the flanges 34, 37. Therefore, the user can insert his/her fingertip onto the concave handle 38 with ease and because the user thereafter inserts other fingertips onto the front side portion 351 of the cover 35', the cover 35' can be readily held as shown by the alternate long and two short dashes line in FIG. 23. Accordingly, the toner container 20A can be readily attached to or detached from the container accommodation chamber Q of the printer 10 (FIG. 2).

As described above, the toner container 20 according to the present embodiment is to be detachably installed into the apparatus main body 11 of the printer 10 in order to replenish the developing device 122 provided in the printer 10 as the image forming apparatus with toner and includes the container 30 longitudinally extending in one direction from which the toner is charged. The container 30 includes the concave handle 38 to be held by the user upon attachment and detachment of the container 30 to the apparatus main body 11, and the concave handle 38 is shifted to the right portion 315 opposing to the left portion 314 including the container side retaining projection 733 for the sake of uplift prevention.

According to the above configuration, since the user can hold the container main body easier comparing to a case where the user directly holds the container 30 because the user holds the concave handle 38, the attachment and detachment of the toner container 20 to and from the apparatus main body 11 can be carried out with ease. Also, since the concave handle 38 is shifted one end of the container 30 in the longitudinal direction, the engagement between the end of the container opposing to the handle 38 and the apparatus main body 11 can be disengaged with relatively small force in terms of moment owing to holding and inclining operation of the concave handle 38. As Such, the container 30 can be attached to or detached from the apparatus main body 11 more easily. Therefore, the inconvenience will be eliminated that an operation will take time upon exchanging the toner container 20, and thus the exchanging operability can be improved.

The container 30 includes the container main body 31 to be charged with toner having a top surface opening and the cover 35 for closing the top surface of the container main body 31, in which the concave handle 38 is provided on the cover 35. Therefore, it is not necessary to modify the construction of the container main body 31 including various main parts of the toner container 20 but it will be sufficient to change design of only the cover 35, resulting in contributing to decrease the manufacturing costs of the container 20.

The concave handle 38 is formed such that longitudinally opposed ends of the cover 35 are recessed in the mutually opposing direction. Therefore, insertion of fingertips into the concave handle 38 enables easier holding of the toner container 20.

In a case where the toner container 20 is to be applied to a multi-color print printer 10 which includes a plurality of toner containers 20 to which different colors of toner are charged and which are installed into the apparatus main body 11 side by side as described in the present embodiment, large spaces come to be produced between the adjacent toner containers 20 because of the concave handles 38 which are provided on the covers 35 of the toner containers 20. Consequently, insertion of the fingers into the spaces enables easier holding of a targeted toner container 20 without being disturbed by the other toner containers 20.

The concave handle 38 is provided with hooking flanges for catching a fingertip. Thus, when the user holds the toner container 20 by inserting his/her fingers onto the concave handles 38 in order to remove the toner container 20 having been installed into the apparatus main body 11, the user's fingertips will be caught by the hooking flanges provided on the concave handles 38. With increased resistance by the hooking flanges, the user can easily remove the toner container 20 from the apparatus main body 11 without causing slipping of the toner container 20.

With regard to a pair of concave handles 38 provided on the cover 35, one is shorter for receiving a thumb and the other is longer for receiving four fingers other then the thumb. Therefore, the thumb can precisely fit into the shorter concave handle 38 and the four fingers other than the thumb can precisely fit into the longer concave handle 38, thereby enabling the toner container 20 to place in an excellently stable holding condition. Further, since the cover 35 has such a thickness in a vertical direction that the fingertips can suitably hold the cover, the fingertips will not loose the cover 35, resulting in achieving secure holding of the cover 35.

Additionally, the container 30 includes a container side retaining projection 733 which is engaged with the groove side retaining projection 82 of the apparatus main body 11. Therefore, the container side retaining projection 733 of the container 30 is engaged with the groove side retaining projection 82 of the apparatus main body with the container 30 installed in the apparatus main body 11, and thus the problem will be prevented from occurrence that the container 30 is accidentally removed from the apparatus main body due to an incorrect operation.

The first and the second embodiments of the present invention have been described above; however, the present invention is not limited to the above embodiments but may include the following modifications.

(1) In the above embodiments, as an example, the color printer 10 is described as the image forming apparatus to which the toner container 20 is to be provided. However, the printer 10 may be a monochrome printer. Also, the image forming apparatus is not limited to a printer but may be a copying machine or a facsimile machine.

(2) In the above embodiments, as an example, the manual operation of the operation lever 642 is described. Instead of manual operation, a structure may be employed such that a guiding member for guiding rotational operation of the operation lever 642 is placed at the container accommodation chamber Q and the operation lever 642 is guided by the guiding member to change its position automatically from the closed position T1 to the open position T2 when the shutter cylinder 60 is inserted into the container accommodation chamber Q. The operation lever 642 is guided in the opposite direction by the guiding member to automatically change its position from the open position T2 to the closed position T1 when the shutter cylinder 60 is taken out of the container accommodation chamber Q. Thus, the necessity of manual operation of the operation lever 642 is eliminated and ease of attachment and detachment of the toner container 20 to and from the apparatus main body 11 is improved.

(3) In the above embodiments, a cap having a shape more suitable for manual operation of the operation lever 642 may be provided to allow easy manual operation of the operation lever 642.

(4) In the above embodiments, the shutter cylinder 60 inserted into the shutter installation cylinder 32 is prevented from dropping out because the retaining claw 621*b* comes into contact with and is stopped by the annular projection 322 of the shutter installation cylinder 32. Instead of this structure, an end surface of the circular closure 63 of the shutter cylinder 60 may be covered by the covering cap 70, thereby preventing the shutter cylinder 60 from dropping out. Accordingly, the necessity of providing the cylindrical retaining body 62 with the retaining claw 621 and the spill holes 622 is eliminated, and thus the shutter cylinder 60 can be made shorter. In this case, an opening on a right surface of the shutter cylinder body 61 of the shutter cylinder 60 serves as a spill hole for releasing the toner.

(5) In the above embodiments, the example is illustrated where the concave handle 38 provided on the cover 35 is provided on a driving force transmitting portion (a side carrying the conveyance gear 35) of the toner container 20. However, the concave handle 38 may be formed on the side carrying including the shutter cylinder 60 as far as it is positioned shifted to a side opposite to a side including the container side retaining projection 733 for the sake of uplift prevention in the X-X direction (widthwise direction).

(6) In the above embodiments, the example is illustrated wherein the two spill holes 622 are provided in the cylinder retaining body 62 of the shutter cylinder 60 in a radial direction in a mutually opposing manner. However, the number of spill holes 622 may be one or may be three or more.

(7) In the above embodiments, the example is illustrated wherein the handle is formed into a concave shape on the cover 35, However, the handle may be formed into a convex shape extending from the cover 35.

(8) In the above embodiment, since the toner container 20 is attached to and detached from the apparatus main body 11, the concave handle 38 is provided on the cover 35 of the container 30 for this attachment and detachment operation. However, if the toner container 20 is attached to and detached from a side of the apparatus main body 11, the concave handle 38 may be provided on a side of the container main body 31 of the container 30.

(9) In the above embodiments, three supporting legs 33 are illustrated. However, the number of supporting legs 33 may be equal to or more than four or may be less than three. If the number of supporting legs 33 is less than three, a supporting portion such as a supporting projection for supporting a bottom portion of the container 30, in particular the arc-like bottom portion 311 of the above embodiment, should be provided at a side of the partition 18 of the apparatus main body 11.

(10) In the above embodiments, the joint cross 42 is employed as the agitating shaft for supporting the agitating blade 45 on the agitator 40. However, it may be replaced with a normal cylinder axis or a square shaft having a square shape in its cross sectional view.

(11) In the above embodiments, only one agitating blade 45 is mounted to the joint cross 42 of the agitator 40. However, a plurality of agitating blades 45 may be mounted to the joint cross 42.

The above described specific embodiments mainly include the invention having the below described configurations.

A toner container according to an aspect of the present invention is to be detachably installed in an apparatus main body of an image forming apparatus for replenishing a developing device provided in the apparatus main body with toner, comprising:

a container for containing toner, and including a first side wall and a second side wall opposed to each other, the container comprising:

a handle to be held when the container is attached to or detached from the apparatus main body; and a retaining portion provided on the first side wall and be engaged with a portion of the apparatus main body when the container is installed in the apparatus main body;

wherein the container longitudinally extends between the first side wall and the second side wall; and the handle is provided at a position shifted to the second side wall from a center of the container in a longitudinal direction.

According to the above described configuration, since the toner container to be charged with toner is installed in the apparatus main body of the image forming apparatus, the toner within the container is supplied to the developing device. The handle is provided on the container so as to be shifted to the second side wall opposing to the first side wall and including the retaining portion of the container. Accordingly, when the user performs some operation, namely, the user holds the handle and lets it decline, the engagement of the retaining portion with the portion of the apparatus main body can be disengaged with less force in terms of moment. Accordingly, the attachment or detachment operation of the toner container to the apparatus main body can be carried out with ease.

In the above described configuration, it may be preferable that the container includes a container main body for containing toner, the container main body having an opening in a top thereof, and a cover for closing the top opening of the container main body, and the handle is provided on the cover.

According to the above described configuration, since the handle is provided on the cover which closes the top opening of the container main body, the handle can be formed such that a design is modified only with respect to the cover without a necessity of modification of a minor specification of the container main body including various main parts of the toner container. Therefore, the manufacturing costs of the toner container can be decreased.

In this case, the cover may preferably include a pair of opposite side surfaces approximately in parallel with a longitudinal direction of the container and the handle is provided such that the pair of side surfaces are recessed in the opposite directions to finally form the handles.

With the above described configuration, the user, for example, inserts his/her thumb onto one of the handles as well as other fingers onto the other handle, thereby enabling holing of the toner container with ease. In a case where the containers are to be applied to a multi-color print image forming apparatus and installed in the apparatus main body such that a plurality of toner containers including different colors of toner are arranged side by side, since the handles are formed on the covers of the toner containers and thus large spaces are produced between the adjacent toner containers due to the handles, the user can hold the toner container with ease only by inserting his/her fingers in those spaces.

Alternatively, the cover may preferably include one side surface generally in parallel with the longitudinal direction of the container and an edge opposing to the side surface, in which the handle is formed into a concave shape by recessing the one side surface in the direction to the edge.

According to the above described configuration, if a plurality of toner containers are arranged side by side, the user can hold an edge on a side where the handle is not formed on the cover by inserting his/her fingers into a space of the handle of the next container. Therefore, only with the handle on the one side surface, the user can hold the toner container with ease.

In the above described configuration, it may be preferable that the handle is provided with hooking flanges for catching fingertips of the user who holds the handle.

According to this configuration, since the user holds the toner container by inserting his/her fingers onto the handle when removing the toner container having installed in the apparatus main body, the user's fingertips are caught by the hooking flanges provided on the handle. Therefore, because of an increased resistance owing to the hooking flanges, the user can easily pick up the toner container without causing a slip.

In the above configuration, it may be preferable that the handle has shorter in length and adapted for receiving a thumb and has longer length on the other side for receiving other fingers.

According to the above described configuration, the thumb is fittingly engaged with the shorter handle and other fingers than the thumb also are fittingly engaged with the longer handle while the user holds the toner container. Consequently, the user can hold the toner container in a suitably stable holding condition.

In the above configuration, it may be preferable that the cover has a vertical dimension of assuring holding by fingertips. According to the configuration, the cover has the vertical dimension capable of being held by the fingertips. Consequently, the fingertips will not loose the cover while the user is holding the cover, resulting in achieving a secure holding of the cover.

In either of the above described configurations, it may be preferable that the retaining projection has elasticity. With this configuration, since the retaining projection can be elastically deformed upon installation of the container into the apparatus main body, the attachment and detachment operation of the container to the apparatus main body improves.

The developer replenishing device according to another aspect of the present invention, comprising:

a container for containing developer, and including a first side wall and a second side wall opposed to each other, the container comprising:

a handle to be held when the container is attached to or detached from the apparatus main body; and a retaining portion provided on the first side wall to be engaged with a portion of the apparatus main body when the container is installed in the apparatus main body;

wherein the container longitudinally extends between the first side wall and the second side wall; and the handle is provided at a position shifted to the second wall from a center of the container in a longitudinal direction.

An image forming apparatus according to still another aspect of the present invention, comprising:

an image carrier for carrying a toner image;

a developing device for supplying toner to the image carrier;

a toner container for replenishing the developing device with toner; and an apparatus main body for accommodating the image carrier, the developing device, and the toner container, and includes a first retaining portion at a position corresponding to a toner container installation position;

wherein the toner container contains toner, and includes a container having a first side wall and a second side wall opposed to each other, the container comprising:

a handle to be held when the container is attached to or detached from the apparatus main body; and a second retaining portion provided on the first side wall to be engaged with the first retaining portion when the container is installed in the apparatus main body;

wherein the container longitudinally extends between the first side wall and the second side wall; and the handle is provided at a position shifted to the second side wall from the center of the container in a longitudinal direction.

According to the present invention, since the handle is provided on the container, the user can hold the container main body by holding the handle easier than a case where the user holds the container directly. Thus, the user can attach and detach the toner container to and from the apparatus main body with ease. The handle is positioned shifted to the second side wall opposing to the first side wall including the retaining portion of the container. Therefore, an operation to hold and incline the handle enables disengagement of the engagement condition between the retaining portion and a portion of the apparatus main body with less force in terms of moment. As such, the user can attach and detach the toner container to and from the apparatus main body more easily. Therefore, upon exchanging the toner container, the working property in exchanging the toner container can be improved.

This application is based on patent application No. 2007-013787 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A toner container to be detachably installed into an apparatus main body of an image forming apparatus for replenishing a developing device provided in the apparatus main body with toner, comprising:

a container for containing toner, and including a first side wall and a second side wall opposed to each other, the container extending longitudinally between the first and second side walls, wherein the container includes:

a container main body for containing the toner and having an opening in a top thereof;

a cover for closing the opening in the top of the container main body;

a handle to be held when the container is attached to or detached from the apparatus main body; and a retaining portion provided on the first side wall and to be engaged with a portion of the apparatus main body when the container is installed in the apparatus main body; wherein the cover has a pair of side surfaces opposed to each other and generally in parallel with a longitudinal direction of the container, and the handle is provided at a position shifted to the second side wall from a center of the container in the longitudinal direction of the container, and is formed into a concave shape by recessing the pair of side surfaces of the cover in opposite directions.

2. The toner container according to claim 1, wherein the handle is provided with hooking flanges for catching fingertips of a user who holds the handle.

3. The toner container according to claim 1, wherein the concave shape formed by recessing one of the side surfaces of the cover to form the handle is shorter in length for receiving a thumb and the concave shape formed by recessing the other one of the side surfaces of the cover to form the handle is longer in length for receiving four fingers other than the thumb.

4. The toner container according to claim 1, wherein the cover has a vertical dimension of assuring holding by fingertips.

5. The toner container according to claim 1, wherein the container main body has a bottom spaced from the cover along an inserting direction, the concave shape defined by recessing the pair of side surfaces of the cover including concave surfaces aligned substantially parallel to the inserting direction of the container into the apparatus main body.

6. The toner container according to claim 5, wherein the handle further includes hooking flanges projecting outwardly and away from one another at positions on the respective concave surfaces spaced from the container main body for catching fingertips of a user who holds the handle.

7. A toner container to be detachably installed into an apparatus main body of an image forming apparatus for replenishing a developing device provided in the apparatus main body with toner, comprising:

a container for containing toner, and including a first side wall and a second side wall opposed to each other, the container comprising:

a container main body having an opening in a top thereof, and a cover for closing the top opening of the container;

a handle to be held when the container is attached to or detached from the apparatus main body; and a retaining portion provided on the first side wall and to be engaged with a portion of the apparatus main body when the container is installed in the apparatus main body;

the cover includes one side surface which is generally in parallel with the longitudinal direction of the container and an edge opposing to the side surface; and the handle is formed into a concave shape by recessing the one side surface in the direction to the edge and is provided at a position shifted to the second side wall from a center of the container in the longitudinal direction of the container.

8. A toner container to be detachable installed into an apparatus main body of an image forming apparatus for replenishing a developing device provided in the apparatus main body with a toner, comprising:

a container for containing the toner, and including a first side wall and a second side wall opposed to each other, the container extending longitudinally between the first side wall and the second side wall, wherein the container includes a handle to be held when the container is attached to or detached from the apparatus main body; and a retaining portion having elasticity, provided on the first side wall, and be engaged with a portion of the apparatus main body when the container is installed in the apparatus main body, wherein the handle is provided at a position shifted to the second side wall from a center of the container in a longitudinal direction of the container.

9. The toner container according to claim 8, wherein:

the container includes a container main body for containing toner, the container main body having an opening in a top thereof, and a cover for closing the top opening of the container main body; and the handle is provided on the cover.

10. The toner container according to claim 9, wherein:

the cover has a pair of side surfaces opposed to each other and generally in parallel with the longitudinal direction of the container; and the handle is formed into a concave shape by recessing the pair of side surfaces in the opposite directions.

11. The image forming apparatus according to claim 8, wherein the cover includes one side surface which is generally in parallel with the longitudinal direction of the container and an edge opposing to the side surface; and the handle is formed into a concave shape by recessing the one side surface in the direction to the edge.

12. An image forming apparatus, comprising:

an image carrier for carrying a toner image;

a developing device for supplying toner to the image carrier;

a toner container for replenishing the developing device with toner; and an apparatus main body for accommodating the image carrier, the developing device, and the toner container, and including a first retaining portion at a position corresponding to an installation position of the toner container;

wherein the toner container comprises:

a container for containing toner, and including a first side wall and a second side wall opposed to each other, the container extending longitudinally between the first side wall and the second side wall, wherein the container includes a container main body for containing the toner and having an opening in a top thereof;

a cover for closing the opening in the top of the container main body;

a handle to be held when the container is attached to or detached from the apparatus main body; and a retaining portion provided on the first side wall and to be engaged with a portion of the apparatus main body when the container is installed in the apparatus main body, wherein the cover has a pair of side surfaces opposed to each other and generally in parallel with a longitudinal direction of the container, and the handle is provided at a position shifted to the second side wall from a center of the container in the longitudinal direction of the container, and is formed into a concave shape by recessing the pair of side surfaces in opposite directions.

13. The image forming apparatus according to claim 12, wherein the handle is provided with hooking flanges for catching fingertips of a user who holds the handle.

14. The image forming apparatus according to claim 12, wherein the concave shape formed by recessing one of the side surfaces of the cover to form the handle is shorter in length for receiving a thumb and the concave shape formed by recessing the other one of the side surfaces of the cover to form the handle is longer in length for receiving four fingers other than the thumb.

15. The image forming apparatus according to claim 12, wherein the cover has a vertical dimension of assuring holding by fingertips.

16. The image forming apparatus according to claim 12, wherein the retaining portion has elasticity.

17. The image forming apparatus according to claim 12, wherein the container main body has a bottom spaced from the cover along an inserting direction, the concave shape defined by recessing the pair of side surfaces of the cover including concave surfaces aligned substantially parallel to the inserting direction of the container into the apparatus main body.

18. The image forming apparatus according to claim 17, wherein the handle further includes hooking flanges projecting outwardly and away from one another at positions on the respective concave surfaces spaced from the container main body for catching fingertips of a user who holds the handle.

* * * * *